US012151861B2

(12) United States Patent
Bogdziewicz et al.

(10) Patent No.: US 12,151,861 B2
(45) Date of Patent: Nov. 26, 2024

(54) TRAY WITH BASE, DOME AND BRIM

(71) Applicant: Altria Client Services LLC, Richmond, VA (US)

(72) Inventors: William J. Bogdziewicz, Richmond, VA (US); Daniel Richter, Richmond, VA (US); Christopher J. Hession, Mechanicsville, VA (US)

(73) Assignee: Altria Client Services LLC, Richmond, VA (US)

( * ) Notice: Subject to any disclaimer, the term of this patent is extended or adjusted under 35 U.S.C. 154(b) by 809 days.

(21) Appl. No.: 17/202,866

(22) Filed: Mar. 16, 2021

(65) Prior Publication Data

US 2022/0297906 A1 Sep. 22, 2022

(51) Int. Cl.
*B65D 51/28* (2006.01)
*B65D 21/02* (2006.01)
*B65D 75/00* (2006.01)

(52) U.S. Cl.
CPC ..... *B65D 51/28* (2013.01); *B65D 21/0237* (2013.01); *B65D 75/004* (2013.01)

(58) Field of Classification Search
CPC ... B65D 51/28; B65D 21/0237; B65D 75/004
USPC ..... 206/503, 505, 507, 508; 220/521
See application file for complete search history.

(56) References Cited

U.S. PATENT DOCUMENTS 3,112,824 A * 12/1963 Lemelson ..... B65D 51/28 53/442
3,326,363 A * 6/1967 Bennett ..... B65D 51/28 426/106
3,670,918 A * 6/1972 Mitchell ..... B65D 81/38 220/592.2
3,907,111 A * 9/1975 Levenhagen ..... B65D 21/0215 206/511
5,407,089 A * 4/1995 Bird ..... B65F 1/16 15/257.1
5,722,558 A 3/1998 Thompson
6,021,903 A * 2/2000 Hanson ..... B65D 51/28 206/541
6,059,153 A * 5/2000 Olson ..... B65D 1/10 222/572

(Continued)

FOREIGN PATENT DOCUMENTS

CA 2499766 A1 * 6/2005 ..... A23G 9/503
CA 2752615 A1 * 3/2013 ..... B65D 43/0212

(Continued)

OTHER PUBLICATIONS

Salaky, Kristin. "Starbucks Is Making Its Strawless Lids Permanent in the U.S.—Delish." Delish, Hearst Magazine Media, Inc. , Sep. 10, 2020, www.delish.com/food-news/a33971779/starbucks-strawless-lids-permanent/. Accessed Oct. 24, 2023. (Year: 2020).*

*Primary Examiner* — Rafael A Ortiz
(74) *Attorney, Agent, or Firm* — Harness, Dickey & Pierce, P.L.C.

(57) ABSTRACT

The tray includes a base, the base including first sidewalls that are substantially cylindrically shaped, a first upper surface on an upper end of the base, a dome, the dome extending upwardly and away from the first upper surface, the first upper surface and the dome closing the upper end, a first brim, the first brim radially extending from a first lower end of the base.

19 Claims, 20 Drawing Sheets

(56) References Cited

U.S. PATENT DOCUMENTS 6,209,725 B1 * 4/2001 Chen ..... B65D 25/02 206/508
6,264,026 B1 * 7/2001 Bradley ..... A47G 19/065 206/217
6,766,902 B1 * 7/2004 Hartelius ..... B65D 51/28 206/217
6,840,398 B1 * 1/2005 Blumenschein ... B65D 43/0212 206/508
7,726,483 B2 * 6/2010 Ramanujam ..... B65D 43/0212 206/508
7,731,047 B2 * 6/2010 Ishimitsu ..... B65D 47/06 220/717
7,934,449 B2 * 5/2011 Anderson ..... B65D 85/36 D7/553.6
8,523,000 B2 * 9/2013 Vovan ..... B65D 1/34 206/505
8,870,010 B2 10/2014 Buck
8,939,312 B1 * 1/2015 Buck ..... B65D 81/3205 220/709
9,622,605 B2 4/2017 Buck
D792,765 S 7/2017 Buck
D832,642 S 11/2018 Buck
10,427,844 B2 * 10/2019 Kovitz ..... B65D 43/0212
2002/0170915 A1 * 11/2002 Hierzer ..... B65D 51/28 220/521
2004/0011831 A1 * 1/2004 McDonald ..... B65D 1/18 222/567
2004/0056053 A1 * 3/2004 Hollander ..... B65D 23/104 222/466
2005/0077262 A1 * 4/2005 Bertani ..... B65D 50/068 215/207
2005/0178677 A1 8/2005 Morrow
2007/0000922 A1 1/2007 Vovan et al.
2007/0277299 A1 12/2007 Kroon
2008/0041850 A1 * 2/2008 Tucker ..... B65D 21/0222 220/326
2009/0000977 A1 * 1/2009 Coonce ..... B65D 43/0202 206/508
2009/0072055 A1 * 3/2009 Flanagan-Kent ..... A01C 15/02 222/533
2009/0090712 A1 * 4/2009 Vovan ..... B65D 21/02 220/793
2009/0108003 A1 * 4/2009 Tripsianes ..... B65D 51/18 220/521
2009/0114650 A1 * 5/2009 Houston, Jr. ..... B65D 51/28 220/256.1
2009/0145874 A1 * 6/2009 Hite ..... B65D 81/366 220/23.86
2010/0264150 A1 * 10/2010 Leon ..... A47G 19/2261 220/669
2010/0301524 A1 * 12/2010 Trude ..... B29C 49/4802 264/523
2011/0031152 A1 * 2/2011 Petlak ..... B65D 1/34 206/503
2011/0114643 A1 * 5/2011 Bogdziewicz ..... A47G 19/065 220/574
2012/0138608 A1 * 6/2012 Rusnak ..... B65D 43/0208 220/254.2
2012/0267381 A1 * 10/2012 Trude ..... B29C 49/54 220/675
2012/0321756 A1 * 12/2012 Estabrook ..... B65D 81/3205 426/115
2013/0008897 A1 * 1/2013 Rusnak ..... B65D 43/0231 220/254.7
2013/0068774 A1 * 3/2013 Buck ..... A47G 19/30 220/521
2013/0119065 A1 * 5/2013 Buck ..... A47G 19/2205 220/523
2013/0233855 A1 * 9/2013 DeSiena ..... B65D 21/022 220/315
2014/0030390 A1 * 1/2014 Coyle ..... B65D 43/02 426/123
2014/0238994 A1 * 8/2014 Christopoulos ..... B65D 51/28 220/254.1
2015/0021335 A1 * 1/2015 Kovitz ..... B65D 43/0212 220/252
2016/0009465 A1 * 1/2016 Pan ..... B65D 21/0219 220/200
2016/0114959 A1 * 4/2016 Strominger ..... B65D 21/0209 220/23.86
2016/0280423 A1 * 9/2016 Luburic ..... B65D 7/04
2019/0168927 A1 * 6/2019 Tyler ..... B65D 25/00
2019/0254293 A1 * 8/2019 Gamay ..... A21D 2/02
2020/0010257 A1 * 1/2020 Lubbe ..... B65D 51/28
2022/0388727 A1 * 12/2022 Schofield ..... A61C 19/00

FOREIGN PATENT DOCUMENTS

DE 202014010186 U1 * 3/2015 ..... B65D 21/0219
DE 202017105008 U1 * 1/2019 ..... B65D 1/26
GB 2412365 A * 9/2005 ..... A63H 37/00
GB 2584452 A * 12/2020 ..... B29C 51/30
WO WO-9621600 A1 * 7/1996 ..... B65D 41/04
WO WO-2004096657 A1 * 11/2004 ..... B65D 43/0212
WO WO-2005077780 A1 * 8/2005 ..... B65D 21/0222
WO WO-2012112228 A1 * 8/2012 ..... B65D 47/043
WO WO-2015089235 A1 * 6/2015 ..... B65D 17/163
WO WO-2019229481 A1 12/2019
WO WO-2020178012 A1 * 9/2020 ..... B65D 41/34
WO WO-2020248162 A1 * 12/2020 ..... A47G 19/2272
WO WO-2021025275 A1 * 2/2021 ..... B65D 43/0204

* cited by examiner

TRAY WITH BASE, DOME AND BRIM

BACKGROUND

Field

Example embodiments generally relate to a tray for stacking of product packages.

Description of Related Art

During a storage and shipment of product packages, product packages can be stacked. Stacking can reduce space and make it easier to distribute product packages.

SUMMARY

At least one example embodiment is directed toward a first tray.

In one example embodiment, the first tray includes a base, the base including first sidewalls that are substantially cylindrically shaped; a first upper surface on an upper end of the base; a dome, the dome extending upwardly and away from the first upper surface, the first upper surface and the dome closing the upper end; a first brim, the first brim radially extending from a first lower end of the base.

In one example embodiment, the first sidewalls and the first upper surface combine to define two or more recesses along an upper periphery of the base, each of the recesses including a step.

In one example embodiment, two or more petaloids exist between the two or more recesses, the two or more petaloids being defined by the first upper surface, the first sidewalls, and side panels of each of the two or more recesses, and the side panels being on either side of a back wall of each of the two or more recesses.

In one example embodiment, the dome is centrally positioned on the first upper surface, the dome having a horizontal cross-section that is circular.

In one example embodiment, the dome includes an annular side surface, the annular side surface being inclined toward a center-point of a top surface of the dome.

In one example embodiment, the two or more petaloids include four petaloids, and the two or more recesses include four recesses.

In one example embodiment, the first sidewalls and the back wall of each of the two or more recesses are inclined toward a center-point of a top surface of the dome.

In one example embodiment, the first brim defines two or more depressions, the two or more depressions extending below a lower major surface of the first brim, the lower major surface being substantially flat, one of the two or more depressions being positioned in front of each one of the two or more petaloids.

In one example embodiment, the first sidewalls and the first upper surface combine to define two or more notches along an upper periphery of the base, each of the two or more notches including a bottom surface that extends into an interior of the first tray.

In one example embodiment, the bottom surface of each of the two or more notches is positioned to contact a second upper surface of a second tray, in order to maintain a separation between the first tray and the second tray once the first tray is stacked on top of the second tray, the second tray being identical to the first tray.

In one example embodiment, an upper portion of each of the two or more petaloids includes one of the two or more notches.

In one example embodiment, the first brim includes an upper major surface, the upper major surface being substantially flat, from a proximal end of the first brim that is connected to the first lower end of the base to a distal end of the first brim.

At least one example embodiment is directed toward a package.

In one example embodiment, the package includes the first tray; and a first tub; a consumer product, the first tray overlaying the consumer product to connect the consumer product to a top portion of the first tub.

In one example embodiment, the dome of the first tray is configured to fit into, and mate with, a recessed area at a second lower end of a second tub to allow the second tub to be stacked on top of, and remain stably connected to, the package.

In one example embodiment, the first brim extends to reach over and contact a distal edge of a second brim of a lid of the first tub.

In one example embodiment, the first brim includes a lower major surface that is substantially flat, and the lower major surface of the first tray sits on top of a third upper surface of a lid of the first tub.

In one example embodiment, at least one first portion of the first sidewalls encompass and hold second sidewalls of the consumer product.

In one example embodiment, the first sidewalls and the first upper surface of the first tray combine to define two or more recesses along an upper periphery of the base, each of the recesses including a step, two or more petaloids exist between the two or more recesses, the two or more petaloids being defined by the first upper surface, the first sidewalls, and side panels of each of the two or more recesses, and the side panels being on either side of a back wall of each of the two or more recesses.

In one example embodiment, the at least one first portion of the first sidewalls of the base include at least part of the back wall of each of the two or more recesses, at least one second portion of the first upper surface of the first tray directly contacts a periphery of an upper-most surface of the consumer product, and a top surface of the dome and the upper-most surface of the consumer product define a gap therebetween.

In one example embodiment, the package further includes shrink wrap, the shrink wrap covering at least one second portion of the first tray and an at least one third portion of an upper portion of the first tub.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

DETAILED DESCRIPTION

Figure 1:
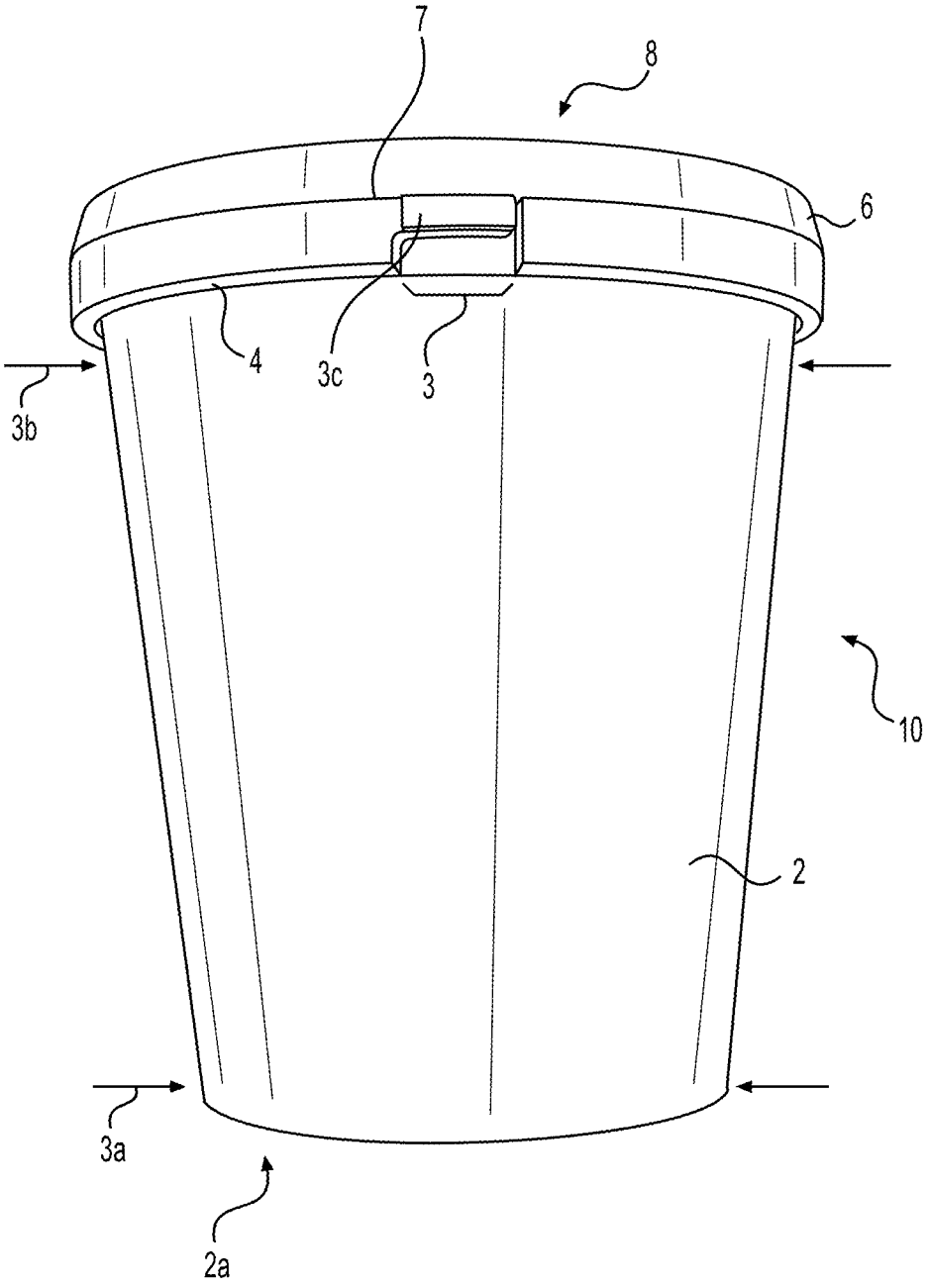
FIG. 1 is an illustration of a perspective view of a tub, in accordance with an example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives thereof. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the words "about" and "substantially" are used in this specification in connection with a numerical value, it is intended that the associated numerical value include a tolerance of ±10% around the stated numerical value, unless otherwise explicitly defined.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

FIG. 1 is an illustration of a perspective view of a tub 10, in accordance with an example embodiment. In an example embodiment, the tub 10 includes a base 2 with a lid 8. In an example embodiment, a lower diameter 3*a* of the base 2 is smaller than an upper diameter 3*b* of the base 2, such that a diameter of the tub tapers toward a lower end 2*a* of the base 2.

In an example embodiment, the base 2 includes a collar 4. In an example embodiment, the collar 4 includes a discontinuous section 3 with a pull tab 3*c* bridging the discontinuous section 3. In an example embodiment, the pull tab 3*c* can be removed to expose a lower edge 7 of an outer surface 6 of the lid 8 to allow the tub 10 to be opened.

Figure 2:
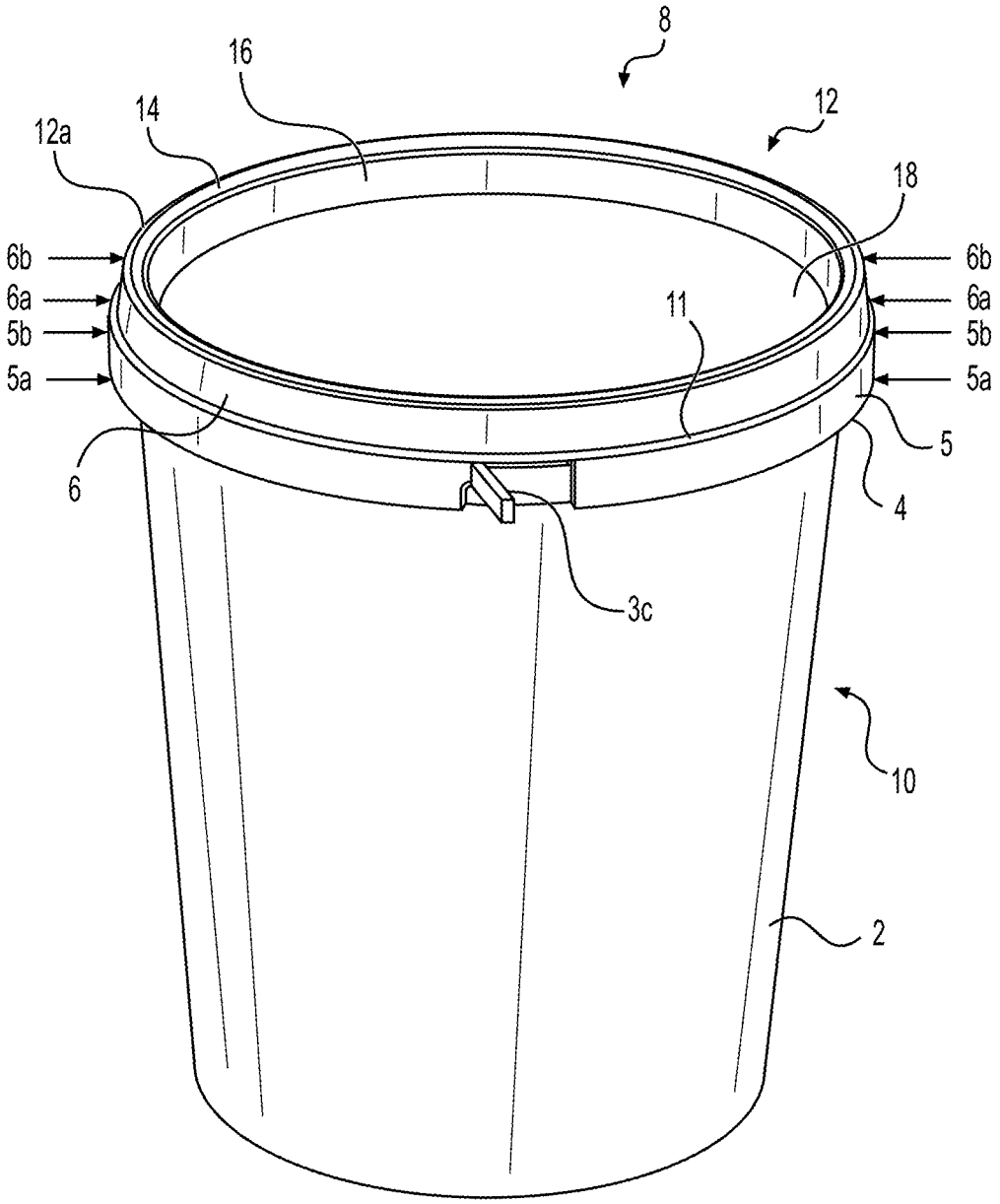
FIG. 2 is an illustration of an upper perspective view of the tub, in accordance with an example embodiment.

FIG. 2 is an illustration of an upper perspective view of the tub 10, in accordance with an example embodiment. In an example embodiment, the lid 8 includes an upper surface 18. In an example embodiment, the upper surface 18 is substantially flat. In an example embodiment, the lid 8 includes a brim 12 with an inner surface 16 that is substantially vertical. In an example embodiment, a beveled surface 14 is between the inner surface 16 and a distal edge 12*a* of the brim 12.

In an example embodiment, the collar 4 includes an outer surface 5. In an example embodiment, the outer surface 5 has a lower diameter 5*a* that is larger than an upper diameter 5*b* (at a higher elevation) of the outer surface 5, such that the outer surface 5 is slightly inclined. In an example embodiment, a lower diameter 6*a* of the outer surface 6 of the lid 8 is larger than an upper diameter 6*b* (at a higher elevation) of the outer surface 6, such that the outer surface 6 is slightly inclined. In an example embodiment, the collar 4 forms an annular step 15, where the annular step 11 abuts the lid 8. In an example embodiment, a slight incline of the outer surface 5 of the collar 4 and the outer surface 6 of the brim 12 of the lid 8 cause the upper edge of the tub 10 (outer surface 5 and outer surface 6) to have a soft, somewhat beveled edge.

Figure 3:
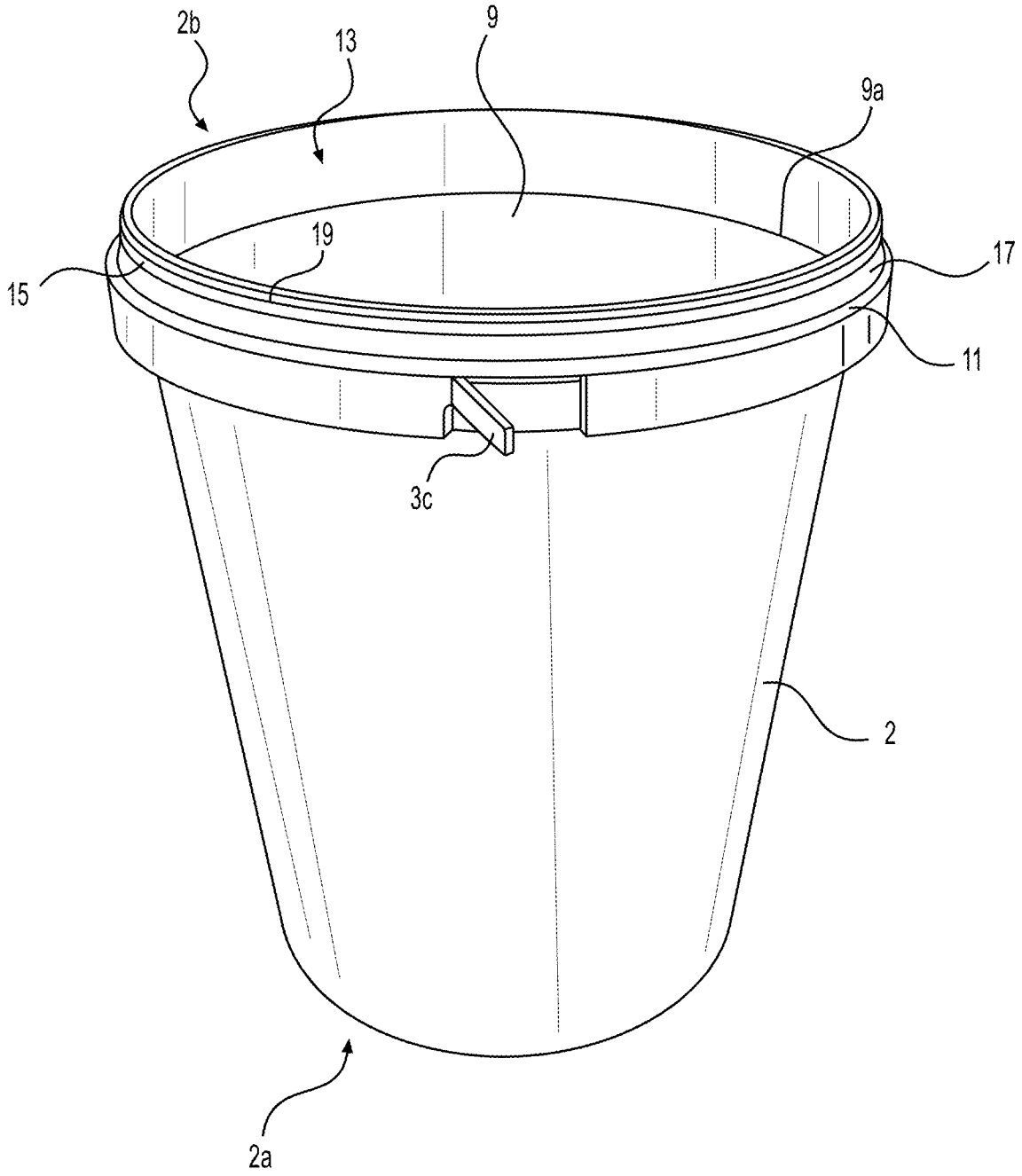
FIG. 3 is an illustration of a perspective view of the base of the tub, in accordance with an example embodiment.

FIG. 3 is an illustration of a perspective view of the base 2 of the tub 10, in accordance with an example embodiment. In an example embodiment, and in this configuration, the pull tab 3*c* has been pulled away and the base 2 has been separated from the lid 8 (lid 8 not shown in FIG. 3).

In an example embodiment, an inner surface 9 of the base 2 defines a cavity 13. In an example embodiment, the cavity 13 can be used to store consumer products. In an example embodiment, the cavity 13 has a cross-sectional diameter that widens from the lower end 2*a* to an upper end 2*b* of the base 2. In an example embodiment, the inner surface 9 has a beveled ledge 9*a*.

In an example embodiment, an upper portion of the base 2 includes an inclined annular surface 17, that is inclined inward toward a center of an opening of the cavity 13. In an example embodiment, an annular vertical surface 15 abuts the inclined annular surface 17. In an example embodiment, a ridge 19 extends along a periphery of a top portion of the annular vertical surface 15.

Figure 4:
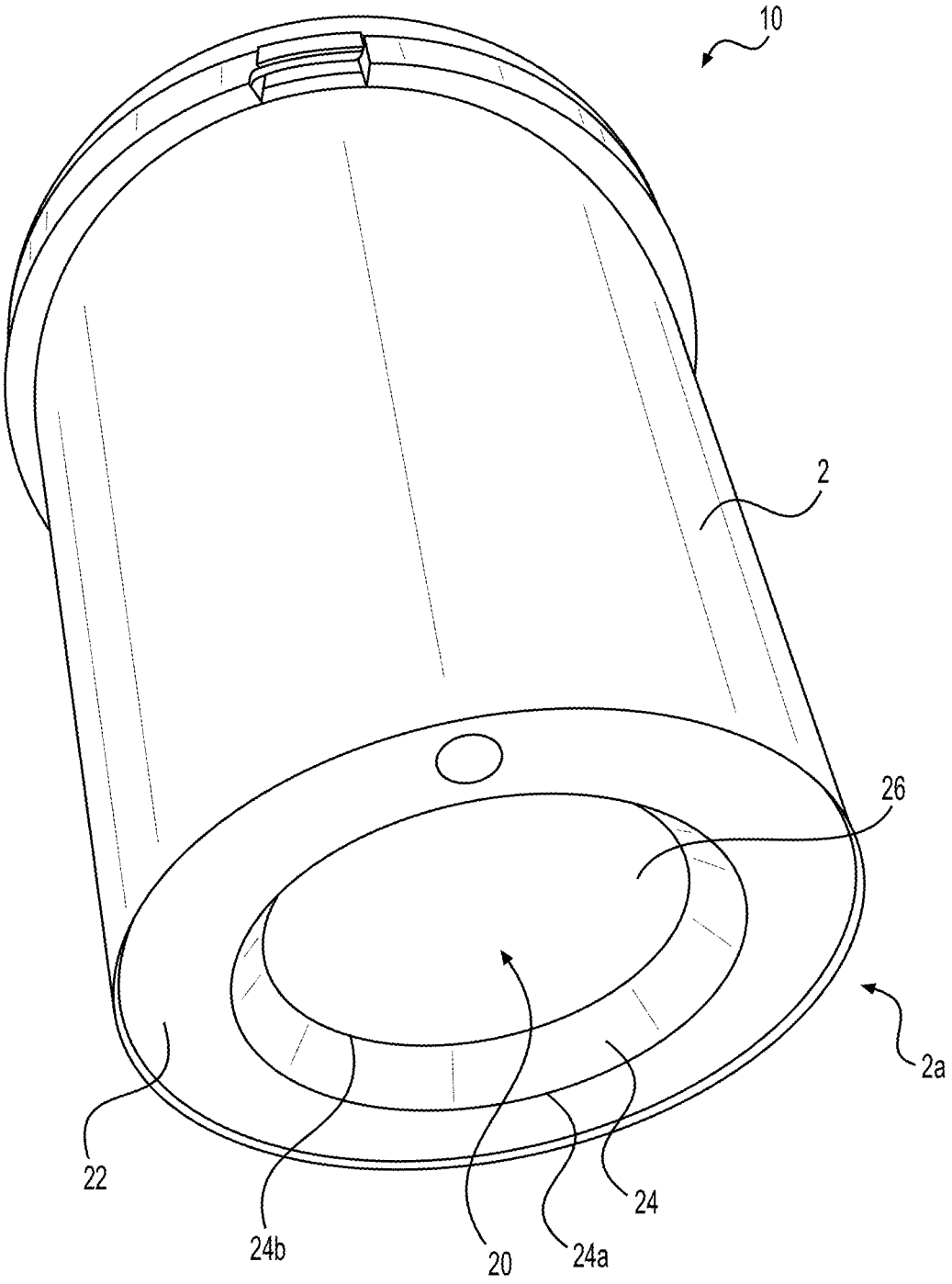
FIG. 4 is an illustration of a lower perspective view of the tub, in accordance with an example embodiment.

FIG. 4 is an illustration of a lower perspective view of the tub 10, in accordance with an example embodiment. In an example embodiment, the lower end 2*a* of the base 2 includes a bottom surface 22 that defines a recessed area 20. In an example embodiment, the recessed area 20 includes a substantially flat central surface 26 and a side surface 24 that is inclined. In an example embodiment, the recessed area 20 has a larger horizontal cross-sectional diameter at a lower edge 24*a* of the side surface 24 relative to a horizontal cross-sectional diameter of the recessed area 20 at an upper edge 24*b* of the side surface 24. In another example embodiment, the side surface 24 is not inclined, and instead the side surface is about perpendicular to the central surface 26.

Figure 5:
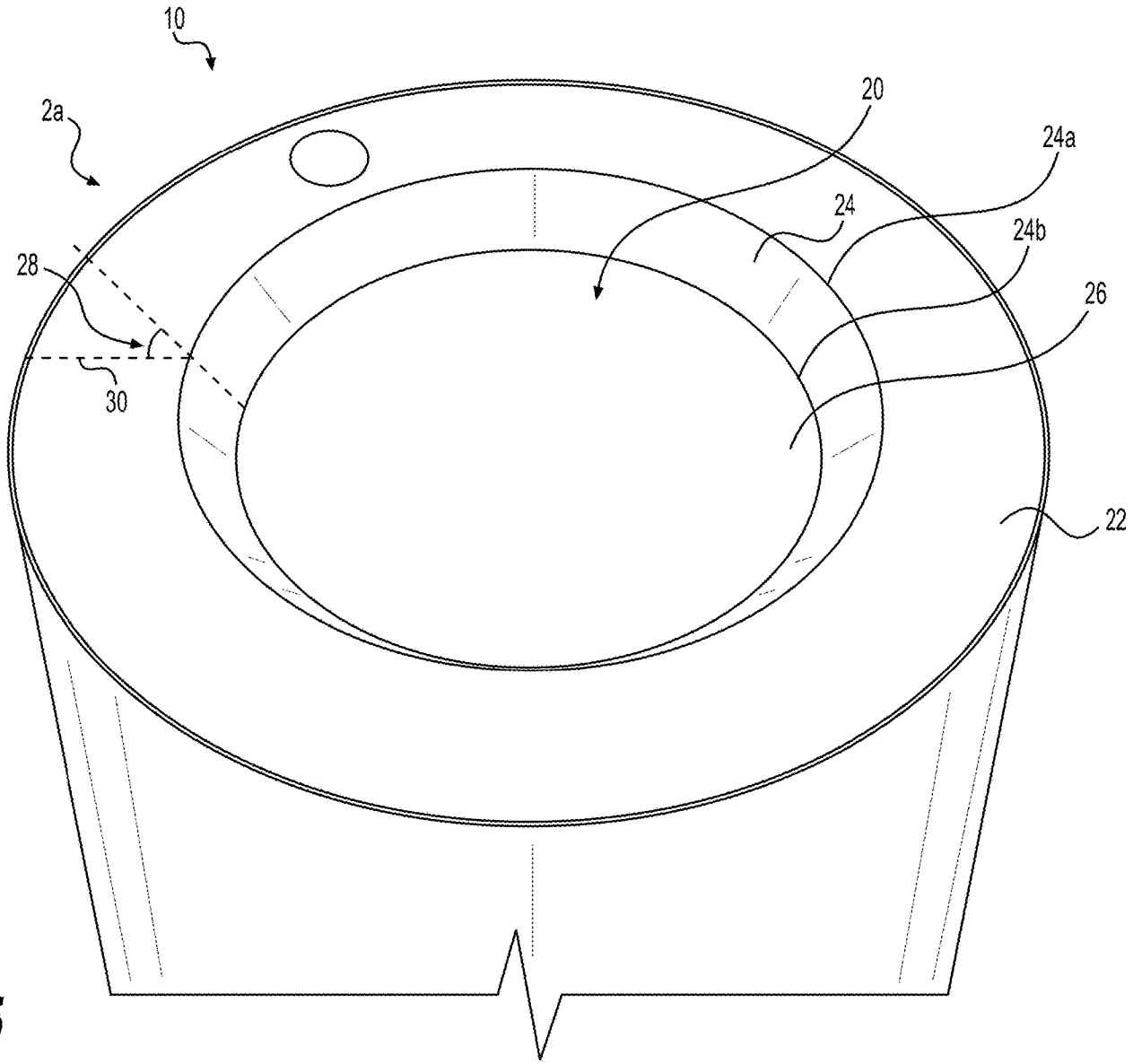
FIG. 5 is an illustration of a close-up view of a bottom of the tub, in accordance with an example embodiment.

FIG. 5 is an illustration of a close-up view of the lower end 2*a* of the tub 10, in accordance with an example embodiment. In an example embodiment, the side surface 24 of the recessed area 20 has an incline angle 28 that is in a range of about 35-70°, relative to a horizontal plane 30 that coincides with the bottom surface 22 of the tub 10. In an example embodiment, the incline angle 28 is about 60° relative to the horizontal plane 30.

Figure 6:
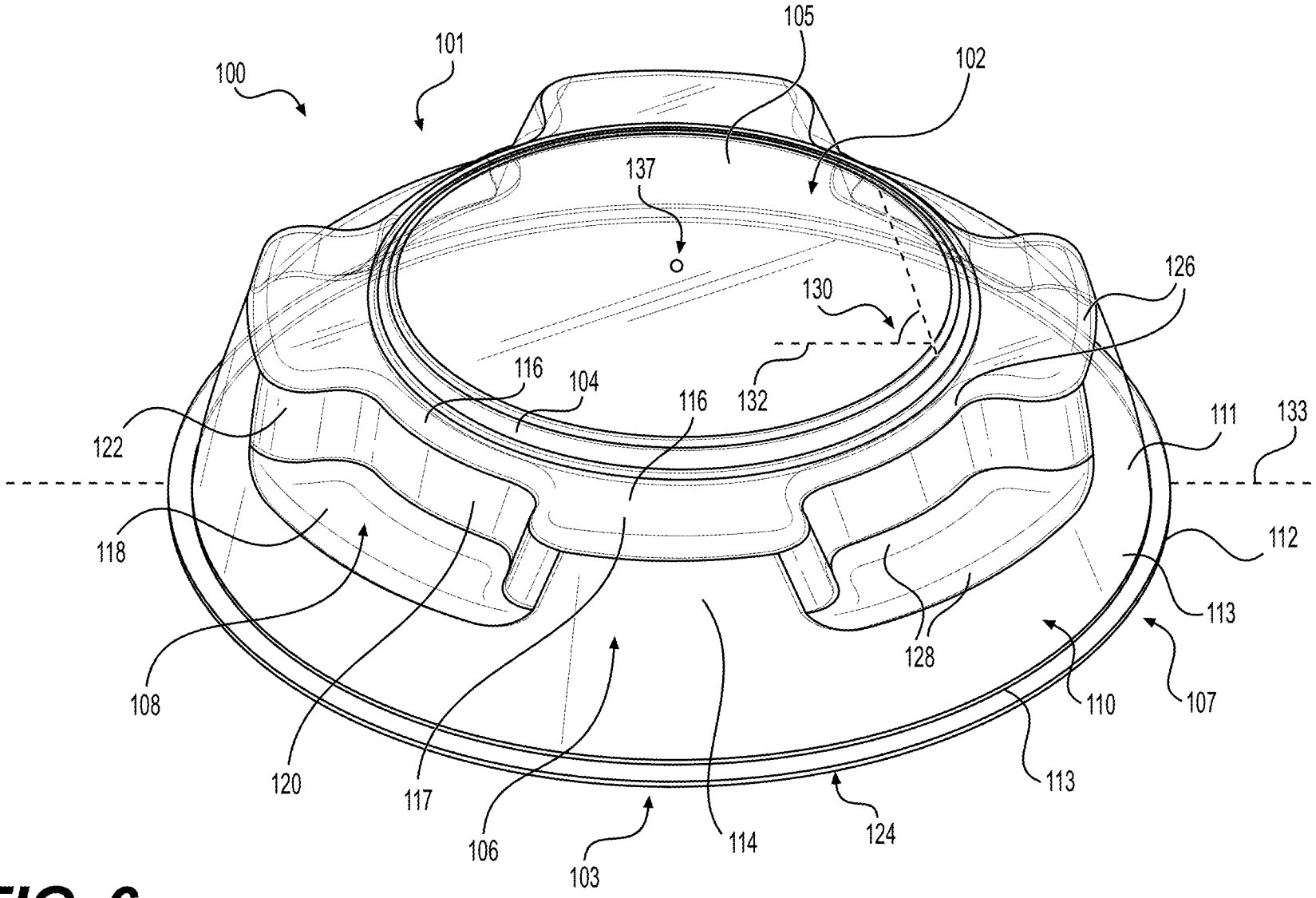
FIG. 6 is an illustration of an upper perspective view of a tray, in accordance with an example embodiment.

FIG. 6 is an illustration of an upper perspective view of a tray 100, in accordance with an example embodiment. In an example embodiment, the tray 100 includes a base 110 that is relatively wide, in comparison to a dome 102 that is on an upper end 101 of the tray 100. In an example embodiment, the base 110 includes sidewalls 111. In an example embodiment, the sidewalls 111 are substantially cylindrically shaped (also see at least FIG. 9). In an example embodiment, the tray 100 has an upper surface 116 on one or more sides, or surrounding, the dome 102. In an example embodiment, the dome 102 extends upward and away from the upper surface 116. In an example embodiment, the dome 102 is centrally positioned on the upper surface 116. In an example embodiment, the dome 102 has a horizontal cross-section that is substantially circular in shape. Said another way, in an example embodiment, the dome 102 is substantially circular, from an overhead vantage point (see at least FIG. 7).

Figure 15:
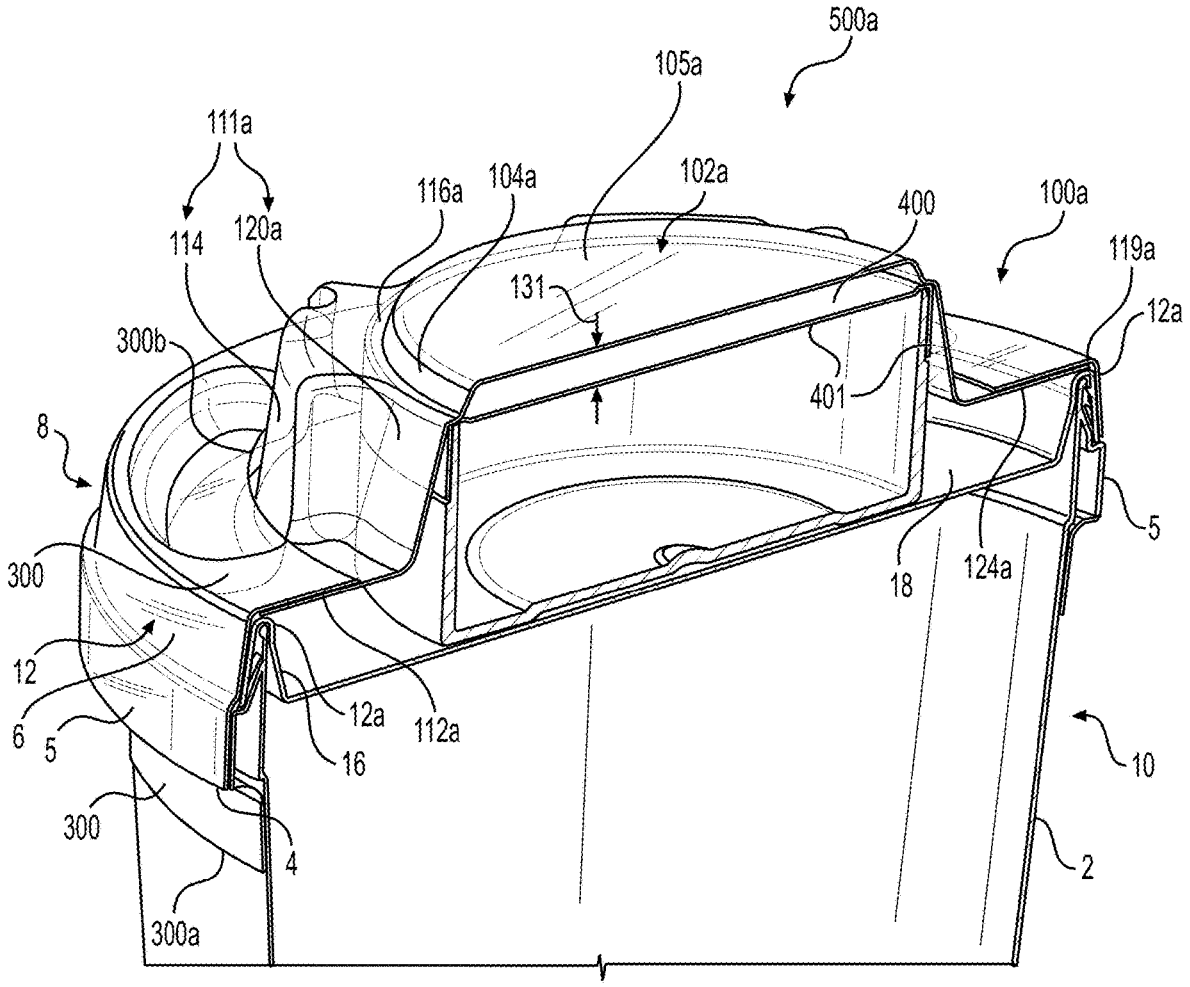
FIG. 15 is an illustration of a cross-sectional view of the package, in accordance with an example embodiment.
Figure 16:
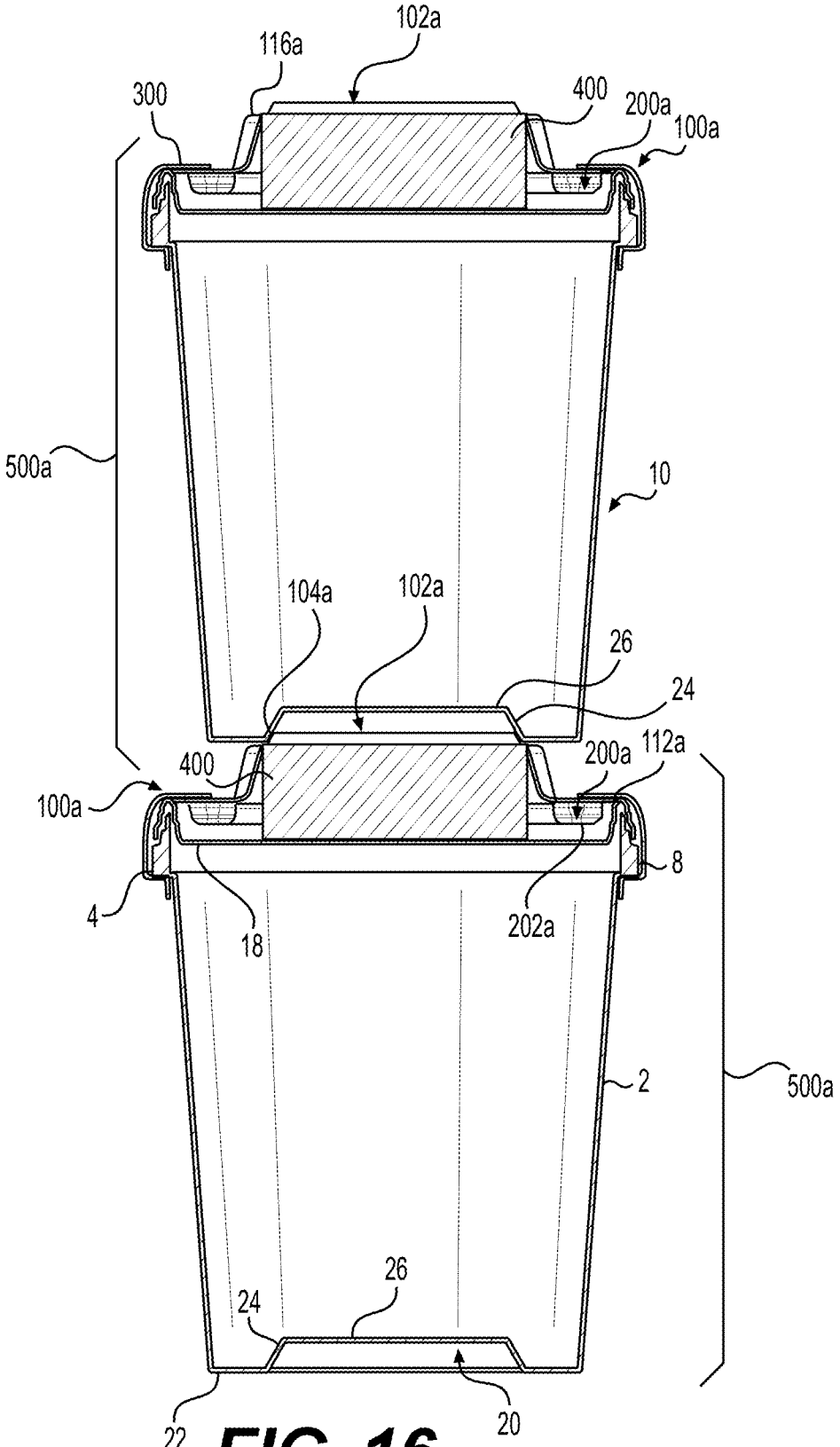
FIG. 16 is an illustration of a cross-sectional view of stacked packages, in accordance with an example embodiment.
Figure 20:
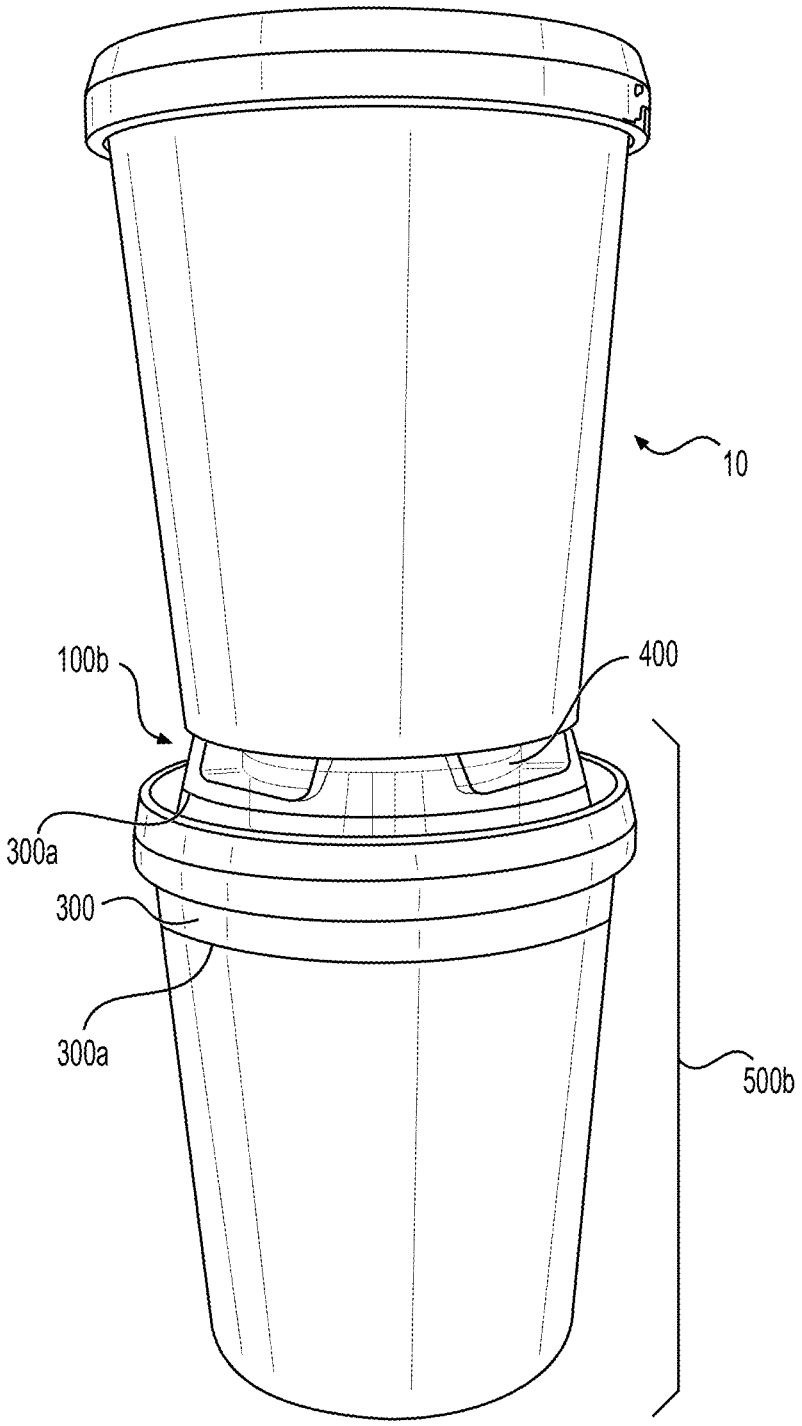
FIG. 20 is an illustration of a perspective view stacked tubs using the tray of FIG. 17, in accordance with an example embodiment.

In an example embodiment, the upper surface 116 of the tray 100 is a weight-bearing surface that receives much the load as a tub 10 is stacked on top of the tray 100, and as further tubs 10 and trays 100 are further stacked together (see FIGS. 16 and 20). In an example embodiment, a lower end 103 of the tray 100 includes a brim 112 that is relatively wider than the base 110. In an example embodiment, the tray 100 can be connected to and/or set on an upper end 2*b* of the tub 10 (see at least FIG. 15), where at least a portion of the dome 102 of the tray 100 is capable of fitting into the recessed area 20 of the tub 10 to allow one or more tubs to be connected to each other (see at least FIGS. 16 and 20). In an example embodiment, the upper surface 116 supports the bottom surface 22 of the base 2 of the tub 10.

In an example embodiment, the sidewalls 111 of the base 110 and the upper surface 116 combine to define one or more recesses 108 along an upper periphery of the base 110. In an example embodiment, a recess 108 exists between a petaloid 106 (described herein). In an example embodiment, the recess 108 includes a step 118. In an example embodiment, the step 118 is a substantially horizontal surface. In an example embodiment, the recess 108 includes a back wall 120 that extends from the step 118 to the upper surface 116. In an example embodiment, the step 118 assists in adding strength to the tray 100 to help support loads that are applied to the upper surface 116 of the tray 100. In an example embodiment, and as shown in at least FIG. 7, the back wall 120 is a surface that is arcuate-shaped (convex). In an example embodiment, the recess 108 is further defined by side panels 122 on adjacent sides of the back wall 120. In an example embodiment, and as shown in at least FIG. 7, the side panels 122 are side surfaces that are substantially S-shaped. In an example embodiment, a number of recesses 108 equals a number of the petaloids 106. In an example embodiment, the number of petaloids 106 are an even number, and the number of recesses 108 match the number of petaloids 106. In an example embodiment, the recesses 108 are spaced equidistantly around a periphery of the upper surface 116 of the tray 100.

In an example embodiment, the upper surface 116, the sidewalls 111 and the side panels 122 combine to form one or more petaloids 106 for the tray 100. In an example embodiment, the one or more petaloids 106 extend upward from a lower portion of the base 110. In an example embodiment, and as shown in FIG. 6, the tray 100 includes four petaloids 106 and four recesses 108. In an example embodiment, the tray 100 includes two, or three, or more than four petaloids 106. In an example embodiment, the sidewalls 111 of the base 110 form an outer surface 114 of each petaloid 106. In an example embodiment, an upper surface 117 of each petaloid 106 is part of the upper surface 116 of the tray 100. In an example embodiment, each petaloid 106 assists in strengthening the tray 100, and allowing the tray 100 to withstand a weight of several tubs 10 stacked on top of each other. In an example embodiment, the one or more petaloids 106 are spaced equidistantly around a periphery of the upper surface 116 of the tray 100.

In an example embodiment, the dome 102 is raised above the upper surface 116 of the tray 100. In an example embodiment, an annular surface 104 of the dome 102 exists between the upper surface 116 of the tray 100 and a top surface 105 of the dome 102. In an example embodiment, the annular surface 104 is inclined at an incline angle 130 that is in a range of about 35-70° relative to a horizontal plane 132, where the horizontal plane 132 is substantially parallel to a horizontal plane 133 that coincides with a lower surface 107 of the tray 100. In an example embodiment, the incline angle 130 is about 60° relative to the horizontal plane 132. In an example embodiment, the incline angle 130 substantially matches the incline angle 28 of the side surface 24 of the recessed area 20 of the tub 10 (see FIG. 5), so that the annular surface 104 of the dome 102 is able to fit into, and mate with, the side surface 24 (see the example embodiment of at least FIG. 16). In another example embodiment, the annular surface 104 is not inclined, and instead the annular surface 104 is about perpendicular to the upper surface 116. In this example embodiment, both the annular surface 104 of the tray 100 and the side surface 24 of the tub 10 are not inclined.

In an example embodiment, upper edges 126 of the petaloid 106 and recess 108 are beveled. In an example embodiment, lower edges 128 of the recess 108 are beveled.

In an example embodiment, the brim 112 extends radially from a lower end 113 of the base 110 of the tray 100. In an example embodiment, a lower major surface 124 of the brim 112 forms the lower surface 107 of the tray 100 (also see FIG. 9). In an example embodiment, and as explained herein, the brim 112 is sized to fit over a top of the distal edge 12*a* of the brim 12 of the tub 10 (see at least FIG. 15), or sized to lay along an upper surface 18 of the tub 10 and inside an inner surface 16 of the brim 12 of the tub 10 (see at least FIG. 19).

Figure 9:
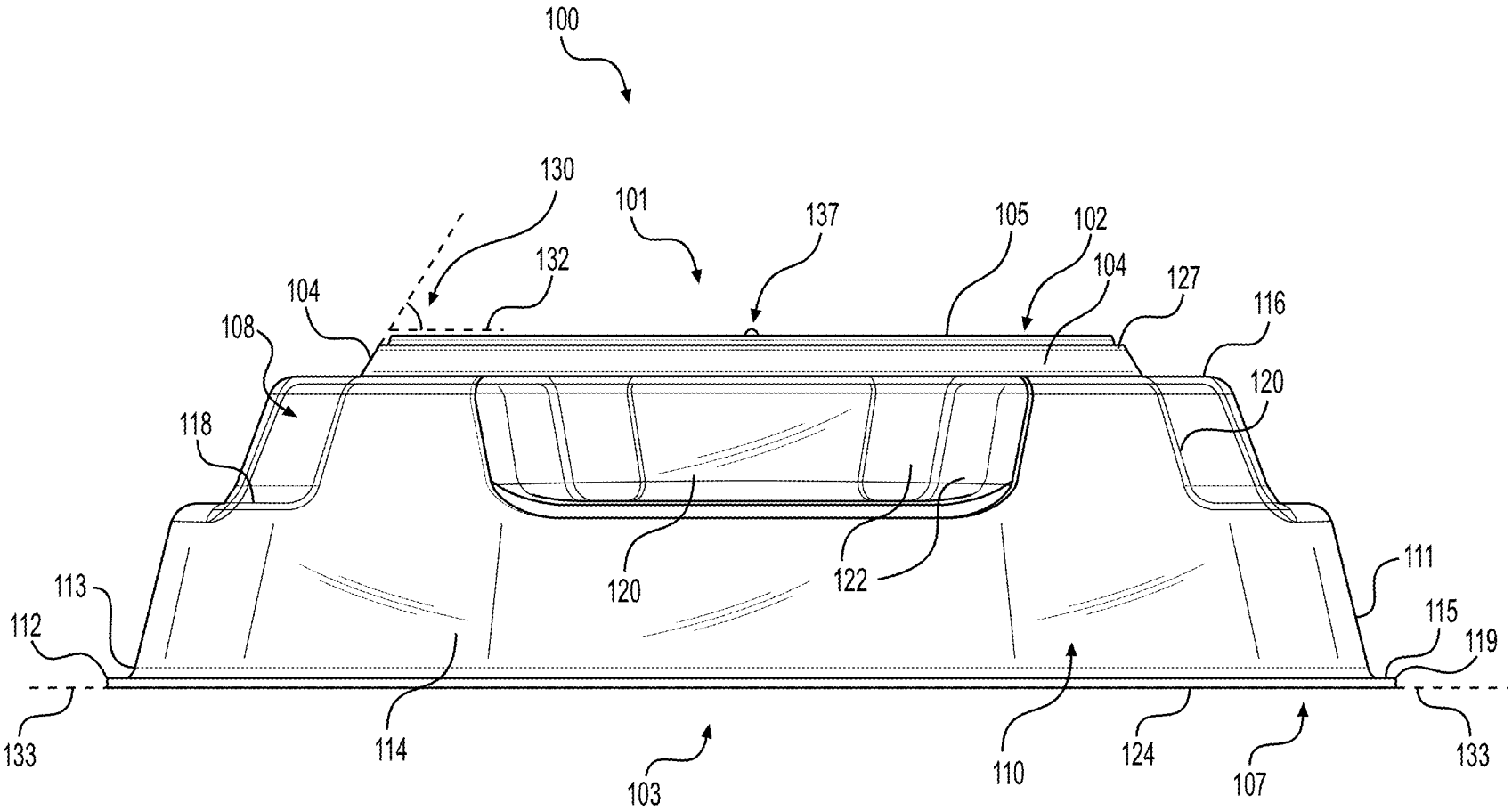
FIG. 9 is an illustration of a side view of the tray of FIG. 6, in accordance with an example embodiment.

In an example embodiment, and as shown in better detail in at least FIG. 9, the sidewalls 111 of the base 110 of the tray 100 are slightly inclined inward (inclined toward a center-point 137 of the dome 102). In an example embodiment, this incline further assists in allowing the upper surface 116 of the tray 100 to carry a load. In another example embodiment, the sidewalls 111 are not inclined, and instead the sidewalls are about perpendicular to the horizontal plane 133.

In an example embodiment, the tray 100 is made from a translucent material or a transparent material. In an example embodiment, the tray 100 is made from an opaque material. In an example embodiment, the tray 100 is made using a thermoformed process, where the material for the tray 100 is heated, then pressed in a mold form, extruded, or otherwise formed into a desired shape of the tray 100.

Figure 7:
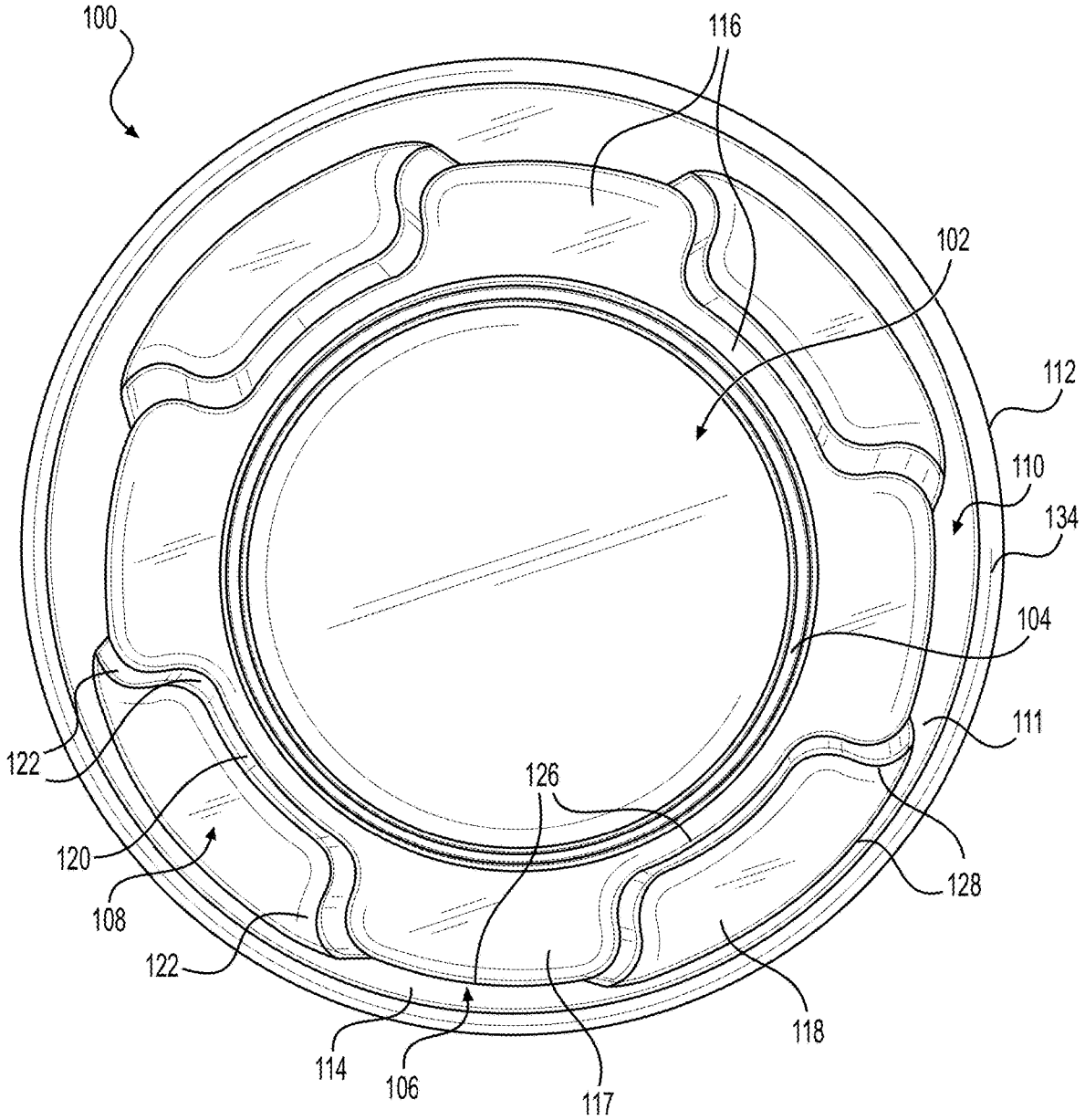
FIG. 7 is an illustration of an overhead perspective view of the tray of FIG. 6, in accordance with an example embodiment.

FIG. 7 is an illustration of an overhead perspective view of the tray 100 of FIG. 6, in accordance with an example embodiment. In an example embodiment, and as shown in FIG. 7, the back wall 120 of the recess 108 is a surface that is somewhat arcuate-shaped (convex). In an example embodiment, the back wall 120 is arcuate-shaped to conform to a generally cylindrical shape of a consumer product 400 (see at least FIG. 15). In an example embodiment, and as shown in FIG. 7, the side panels 122 of the recess 108 are substantially S-shaped.

In an example embodiment, the back wall 120 and the side panels 122 of the recess 108 are inclined to gradually slope toward the dome 102, as shown in better detail in at least FIG. 9. In an example embodiment, the sidewalls 111 of the base 110 and the outer surface 114 of the petaloid 106 are inclined to gradually slope toward the dome 102, as shown in better detail in at least FIG. 9. In an example embodiment, an incline of the back wall 120, the side panels 122, the sidewalls 111 and the outer surface 114 strengthen the tray 100 to support a load on the upper surface 116.

Figure 8:
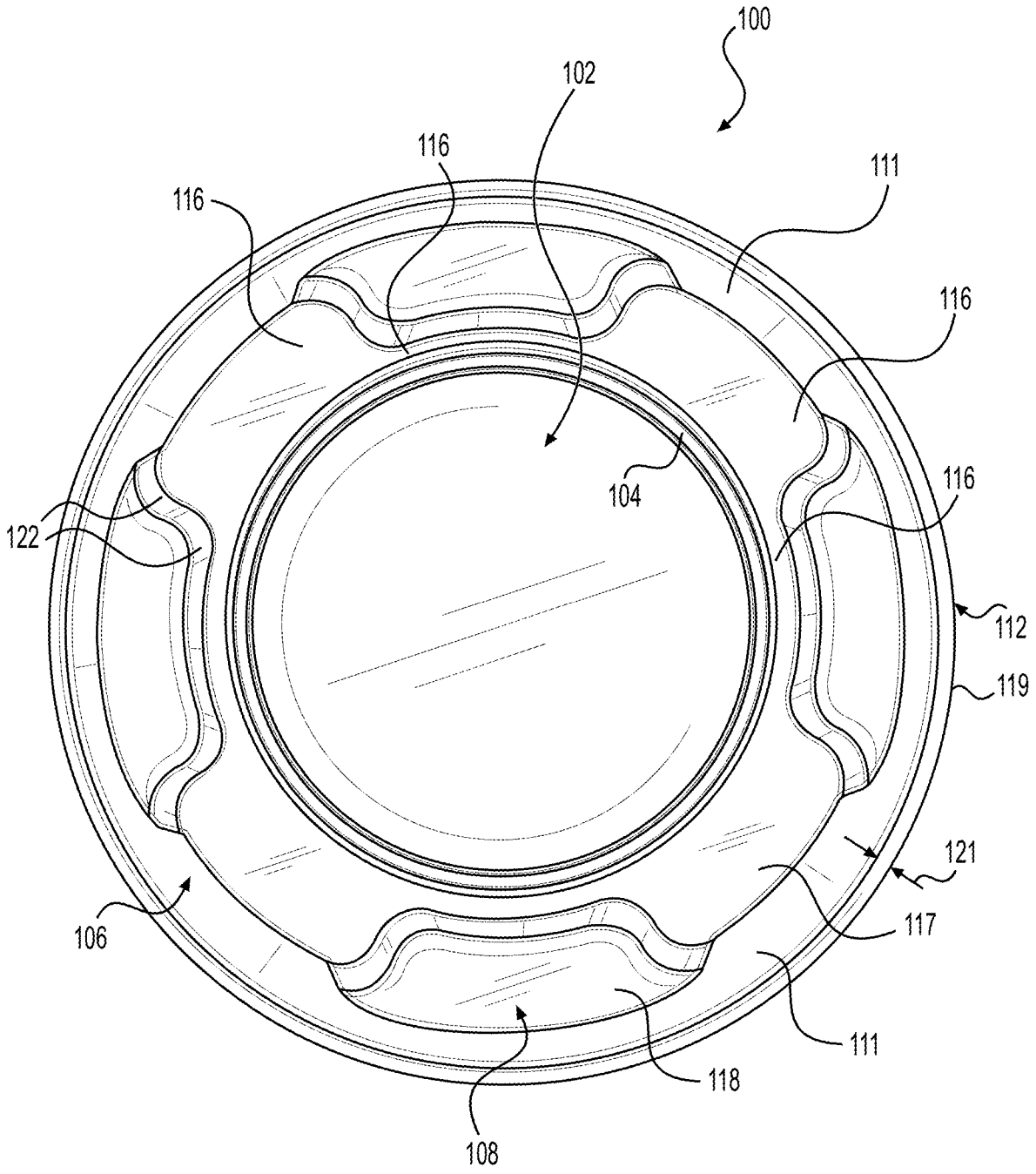
FIG. 8 is an illustration of a lower perspective view of an interior of the tray of FIG. 6, in accordance with an example embodiment.

FIG. 8 is an illustration of a lower perspective view of an interior of the tray 100 of FIG. 6, in accordance with an example embodiment. In an example embodiment, and as shown in FIG. 8, a width 121 of the brim 112 can be based on a dimension of the lid 8 of the tub 10. In an example embodiment, the brim 112 of the tray 100 rests on the upper surface 18 of the tub 10, where a distal end 119 of the brim 112 contacts an inner surface 16 of the lid 8 (see FIG. 2). In this embodiment, the width 121 of the brim 112 can be relatively narrow, as compared for instance to a brim 112*a* of the tray 100*a* of FIG. 10 (where the brim 112*a* of the tray 100*a* fits over a top of the brim 12 of the tub 10, as shown in at least FIG. 15).

FIG. 9 is an illustration of a side view of the tray 100 of FIG. 6, in accordance with an example embodiment. In an example embodiment, the tray 100 is substantially shaped in the form of a cup, where the sidewalls 111 of the base 110 are substantially cylindrically shaped, the upper end 101 of the tray 100 is sealed (closed) by the upper surface 116 and the dome 102, and the lower end 103 of the tray 100 is open with the brim 112 extending radially from the lower end 113 of the base 110. In an example embodiment, and as shown in FIG. 9, the sidewalls 111 of the base 110 are inclined (sloped) inward toward the center-point 137 of the dome 102, as the sidewalls 111 extend from the lower surface 107 of the tray 100 toward the upper end 101 of the tray 100. In an example embodiment, the back wall 120 of the recess 108, and the outer surface 114 of the petaloid 106, are sloped (inclined) inward toward the center-point 137 the dome 102, as the back wall 120 and the outer surface 114 extend upward toward the upper end 101 of the tray 100. In an example embodiment, the incline of the sidewalls 111 and/or the back wall 120 provide structural support (strength) for the upper surface 116, so loads can be placed on the upper surface 116. In an example embodiment, the incline of the sidewalls 111 and/or the back wall 120 are about equal to the incline angle 130 of the annular surface 104. In an example embodiment, the step 118 of the recess 108 exists in a horizontal plane that is about parallel to the horizontal plane 133 that coincides with the lower surface 107 of the tray 100. In another example embodiment, the sidewalls 111, the back wall 120, the side panels 122 and/or the outer surface 114 are not inclined, but instead are about perpendicular to the horizontal plane 133.

In an example embodiment, and as also described in relation to FIG. 6, the annular surface 104 of the dome 102 is sloped (inclined) inward toward the center-point 137 of the dome 102, as the annular surface 104 extends upward toward the upper end 101 of the tray 100. In an example embodiment, the incline angle 130 of the annular surface 104 substantially matches the incline angle 28 of the side surface 24 of the tub 10 (FIG. 5). In an example embodiment, a bevel (annular step) 127 is included between the annular surface 104 and the top surface 105 of the dome 102. In an example embodiment, the bevel 127 makes it easier to disengage the dome 102 from the recessed area 20 of the tub 10, especially when a packages 500*a* is stacked on top of other packages 500*a* and a significant amount of load (weight) is pressing down onto the dome 102 (see at least the embodiment of FIG. 16).

In an example embodiment, the brim 112 of the tray 100 has an upper major surface 115 and a lower major surface 124 that are both substantially flat surfaces, from a proximal end of the brim 112 that connects to the lower end 113 of the base 110 to the distal end 119 of the brim 112.

Figure 10:
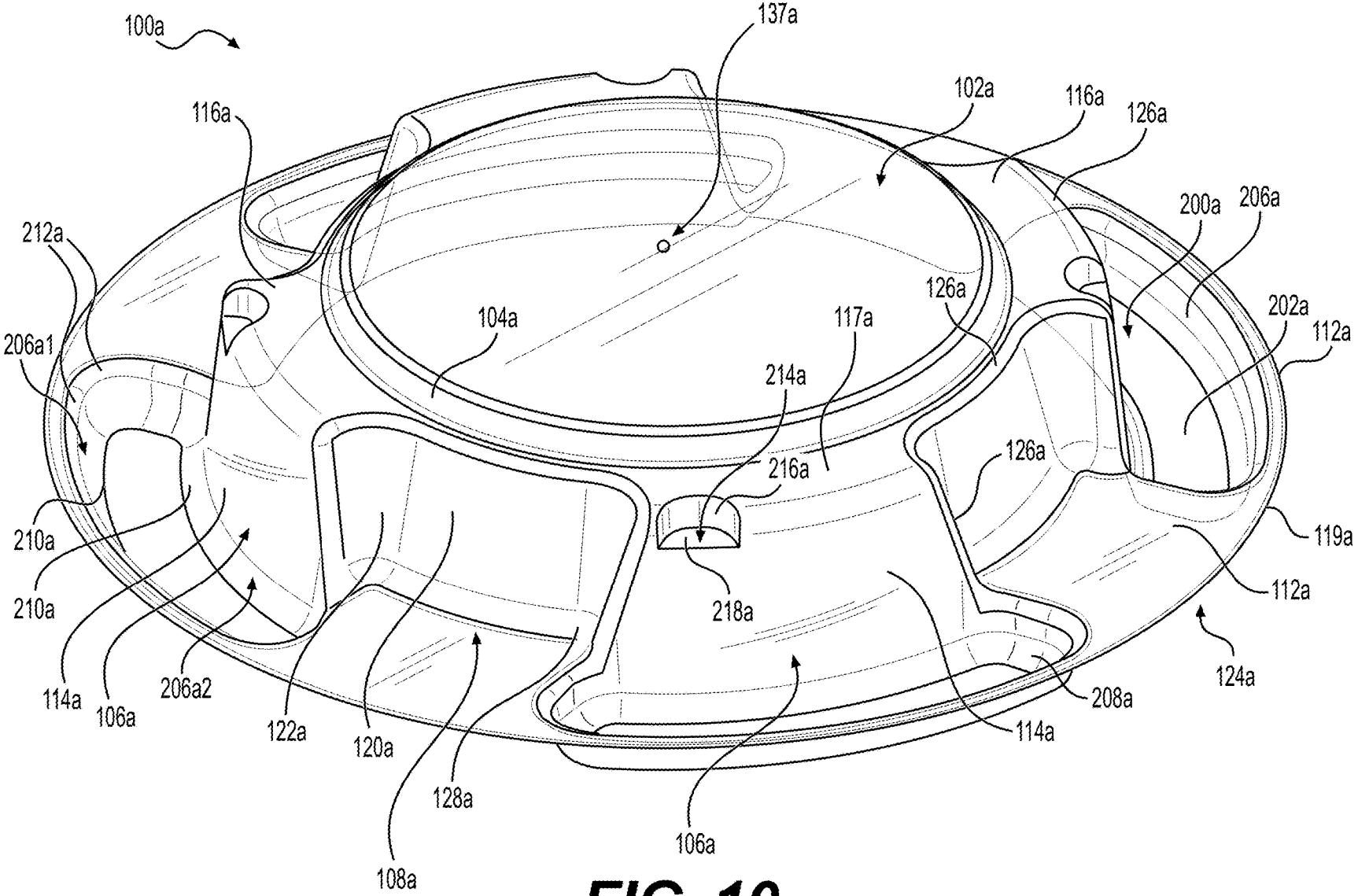
FIG. 10 is an illustration of an upper perspective view of another tray, in accordance with an example embodiment.

FIG. 10 is an illustration of an upper perspective view of another tray 100*a*, in accordance with an example embodiment. For brevity sake, like references numbers are the same as those described in relation to the tray 100 (FIG. 6), with the following exceptions described herein. In an example embodiment, the tray 100*a* includes at least one depression 200*a*. In an example embodiment, the at least one depression 200*a* is a depression that extends below a lower major surface 124*a* of the brim 112*a* of the tray 100*a*. In an example embodiment, the depression 200*a* is defined by a floor 202*a*, where the floor 202*a* is a lowest surface of the depression 200*a*, and also a lowest surface of the tray 100*a*. In an example embodiment, the depression 200*a* is further defined by a wall 206*a*. In an example embodiment, the wall 206*a* gives the depression 200*a* a free-form shape, as viewed from an overhead perspective (see at least FIG. 11). In an example embodiment, the wall 206*a* includes a front wall 206*a*1 that is arcuate-shaped (concave) that is conformed to a shape of a distal end 119*a* of the brim 112*a* of the tray 100*a*. In an example embodiment, the wall 206*a* includes a back wall 206*a*2 that is arcuate-shaped (convex) that is conformed to a shape of an outer surface 114*a* of one or more petaloids 106*a*. In an example embodiment, the front wall 206*a*1 and the back wall 206*a*2 oppose each other. In an example embodiment, the at least one depression 200*a* strengthens an overall structure of the tray 100*a*, and mitigates against a catastrophic crushing of the lid 8 of the tub 10 once the tray 100*a* is incorporated into the package 500*a* (see at least FIGS. 14 and 15).

In an example embodiment, the outer surface 114*a* of the one or more petaloids 106*a* extends downward from an upper surface 116*a* of the tray 100*a* to form the back wall 206*a*2 of the depression 200*a*. In an example embodiment, a depression 200*a* exists in front of each of the one or more petaloids 106*a*. In an example embodiment, the upper surface 116*a* of the tray 100*a* and the outer surface 114*a* of the petaloid 106*a* define a notch 214*a*. In an example embodiment, there is one notch 214*a* for each petaloid 106*a*. In an example embodiment, the notch 214*a* exists anywhere along an upper surface 117*a* of the petaloid 106*a*. In an example embodiment, the notch 214*a* is defined by a bottom surface (floor) 218*a* and a back surface 216*a*. In an example embodiment, the back surface 216*a* is substantially arcuate-shaped (concave). In an example embodiment, the bottom surface 218*a* is flat and exists in a horizontal plane that is about parallel with the upper surface 116*a* of the tray 100*a*. In an example embodiment, the bottom surface 218*a* extends downward into an interior of the tray 100*a*. In an example embodiment, the bottom surface 218*a* contacts an upper surface 116*a* of another tray 100*a*, when the trays 100*a* are stacked (see FIG. 13), where the notch 214*a* provides separation between the stacked trays 100*a*, as explained in more detail in relation to FIG. 13.

In an example embodiment, a number of the one or more petaloids 106*a* matches a number of depressions 200*a*. In an example embodiment, a position and a number of the one or more petaloids 106*a* and the recesses 108*a* match the placement and the number of the one or more petaloids 106 and the recesses 108 that are described in relation to the tray 100 (see at least FIGS. 6 and 9). In an example embodiment, a number of the petaloids 106*a* is an even number, and a number of the recesses 108*s* match the number of petaloids 106*a*. In an example embodiment, the petaloids 106*a* and the recesses 108*a* are spaced equidistantly around a periphery of the upper surface 116*a* of the tray 100*a*.

In an example embodiment, a back wall 120*a* of the recess 108*a* extends downward, from the upper surface 116*a* of the tray 100*a* down to the brim 112*a*. In an example embodiment, the recess 108*a* includes side panels 122*a* that are arcuate-shaped (concave), as can be seen in better detail in FIG. 11.

In an example embodiment, upper and side edges 126*a* of the one or more petaloids 106*a* and the recesses 108*a* are beveled. In an example embodiment, upper edges 212*a* and lower edges 210*a* of the depression 200*a* are beveled.

In an example embodiment, an annular surface 104*a* of the dome 102*a* is inclined toward a center-point 137*a* of the dome 102*a*, identical to the annular surface 104 of the tray 100 (see the discussion in relation to at least FIG. 6). In an example embodiment, the outer surface 114*a* of the petaloid 106*a* and/or the back wall 120*a* of the recess 108*a* are both inclined toward the center-point 137*a*. In an example embodiment, an incline angle of the outer surface 114*a* and/or the back wall 120*a* are identical to the incline angle 130 of the annular surface 104 of the tray 100 (see the discussion in relation to at least FIG. 6). In another example embodiment, the annular surface 104*a*, the outer surface 114*a* and/or the back wall 120*a* are not inclined, but instead are about perpendicular to a horizontal plane of an upper major surface 115*a* of the brim 112*a* (see FIG. 12).

Figure 11:
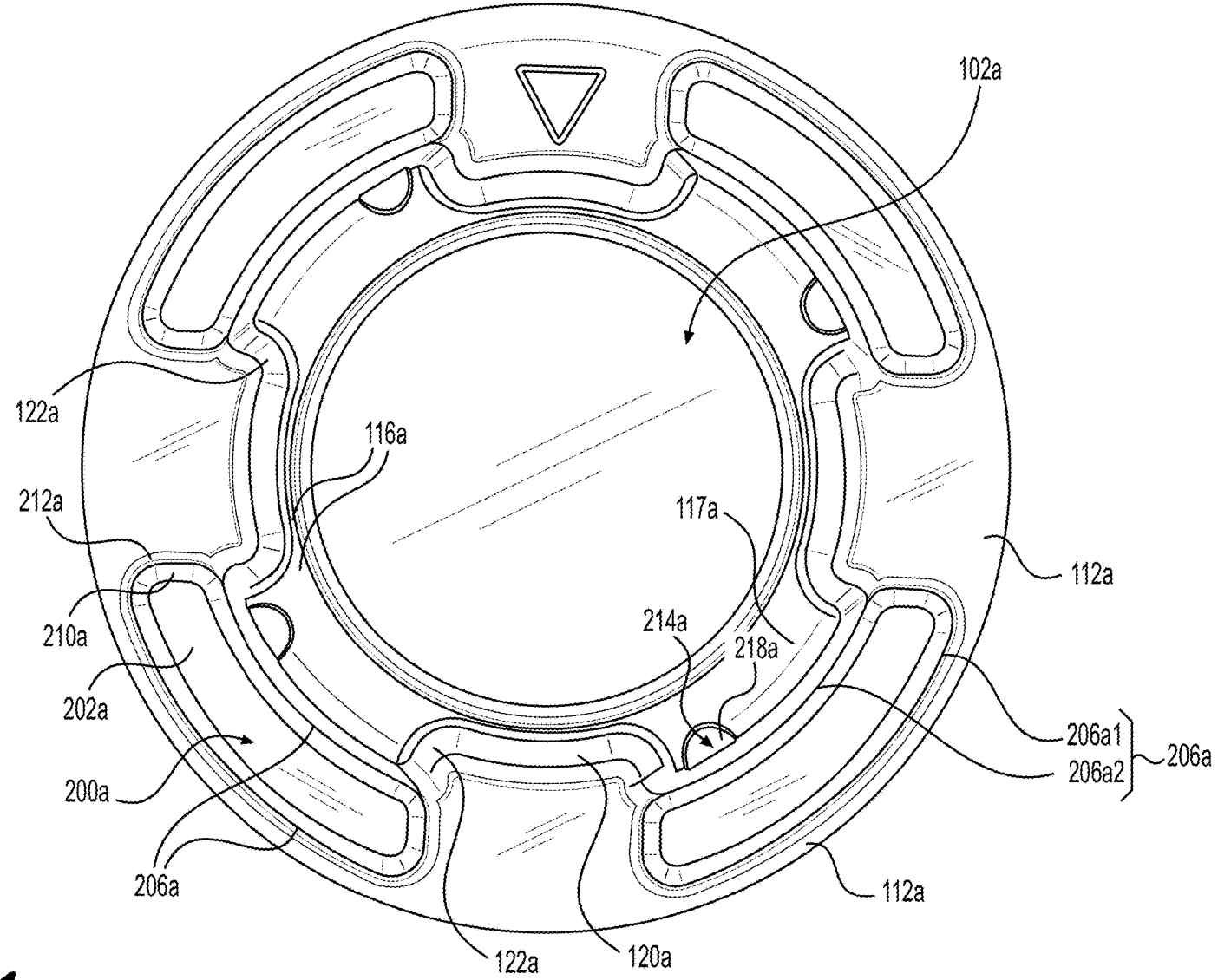
FIG. 11 is an illustration of an upper view of the tray of FIG. 10, in accordance with an example embodiment.

FIG. 11 is an illustration of an upper view of the tray of FIG. 10, in accordance with an example embodiment. In an example embodiment, the wall 206*a* of the depression 200*a* gives the depression 200*a* a free-form shape, from the upper (overhead) perspective as shown in FIG. 11. In an example embodiment, the wall 206*a* includes the front wall 206*a*1 and the back wall 206*a*2, that are both arcuate-shaped (concave and convex, respectively) and oppose each other.

Figure 12:
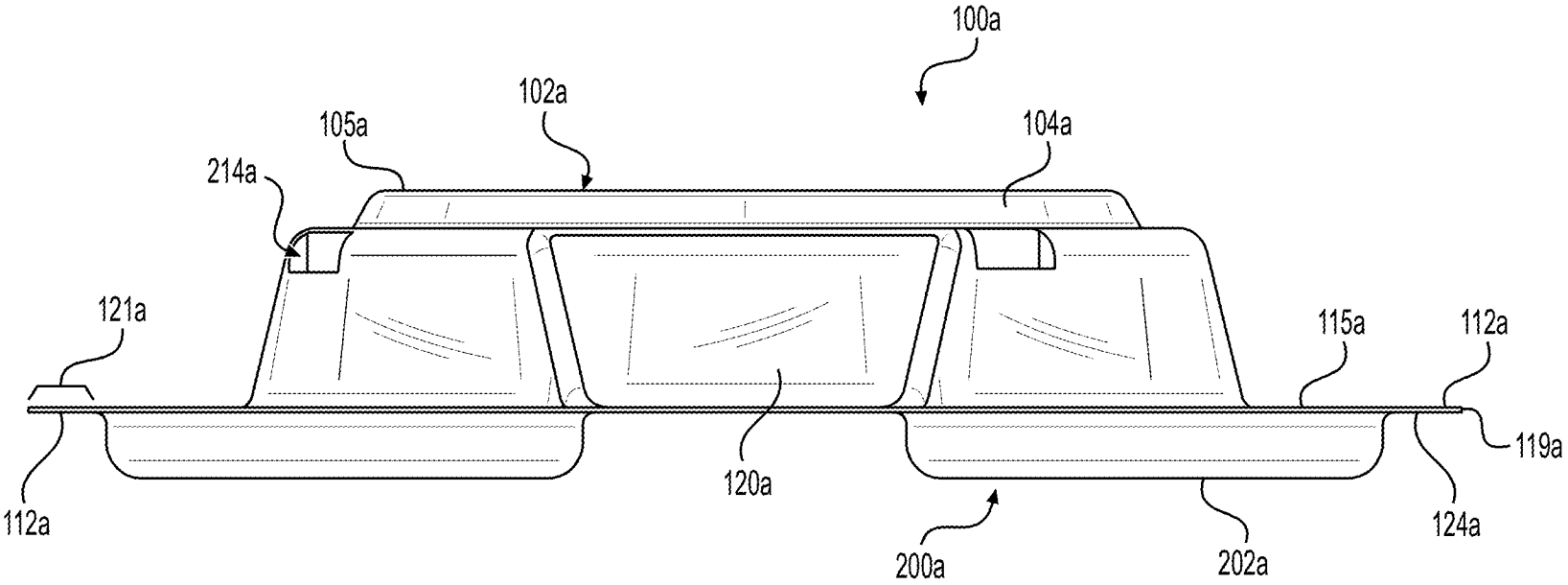
FIG. 12 is an illustration of a side view of the tray of FIG. 10, in accordance with an example embodiment.

FIG. 12 is an illustration of a side view of the tray of FIG. 10, in accordance with an example embodiment. In an example embodiment, a width 121*a* of the brim 112*a* of the tray 100*a* is wide enough that the lower major surface 124*a* of the brim 112*a* is capable of sitting on top of the distal edge 12*a* of the brim 12 of the tub 10 (see at least FIG. 15). In an example embodiment, this feature of the tray 100*a* is different from the tray 100 (FIG. 6) and a tray 100*b* (FIG. 17), where the brim 112 of tray 100 and a brim 112*b* of the tray 100*b* sit on the upper surface 18 of the tub 10 (see at least FIG. 19). In another example embodiment, the width 121*a* of the brim 112*a* is narrow enough that the distal end 119*a* of the brim 112*a* cannot reach the brim 12 of the tub 10, and therefore the floor 202*a* of the depression 200*a* can sit on the upper surface 18 of the tub 10.

In an example embodiment, the depression 200*a* is defined by the brim 112*a*, and the depression 200*a* extends below the lower major surface 124*a* of the brim 112, where the lower major surface 124*a* is substantially flat. In an example embodiment, the depression 200*a* provides load-support strength to the tray 100*a* to allow the tray 100*a* to support additional tubs 10 and/or additional weight on the upper surface 116*a* of the tray 100*a*. In an example embodiment, the floor 202*a* of the depression 200*a* extends below the lower major surface 124*a* of the brim 112*a* only to a midway point, between the lower major surface 124*a* and the upper surface 18 of the tub 10, once the tray 100*a* is fitted onto the tub 10 and the brim 112*a* of the tray 100*a* rests on the distal edge 12*a* of the brim 12 of the lid 8 of the tub 10 (see FIG. 15). In an alternative example embodiment, the floor 202*a* of the depression 200*a* extends below the lower major surface 124*a* of the brim 112*a* so that the floor 202*a* contacts and is supported by the upper surface 18 of the tub 10 (not shown).

In an example embodiment, the brim 112*a* of the tray 100*a* has the upper major surface 115*a* and the lower major surface 124*a* that are both substantially flat and exist in a horizontal plane. In an example embodiment, the depression 200*a* is defined by a remaining portion of the brim 112*a*, that is aside from the upper major surface 115*a* and the lower major surface 124*a*.

Figure 13:
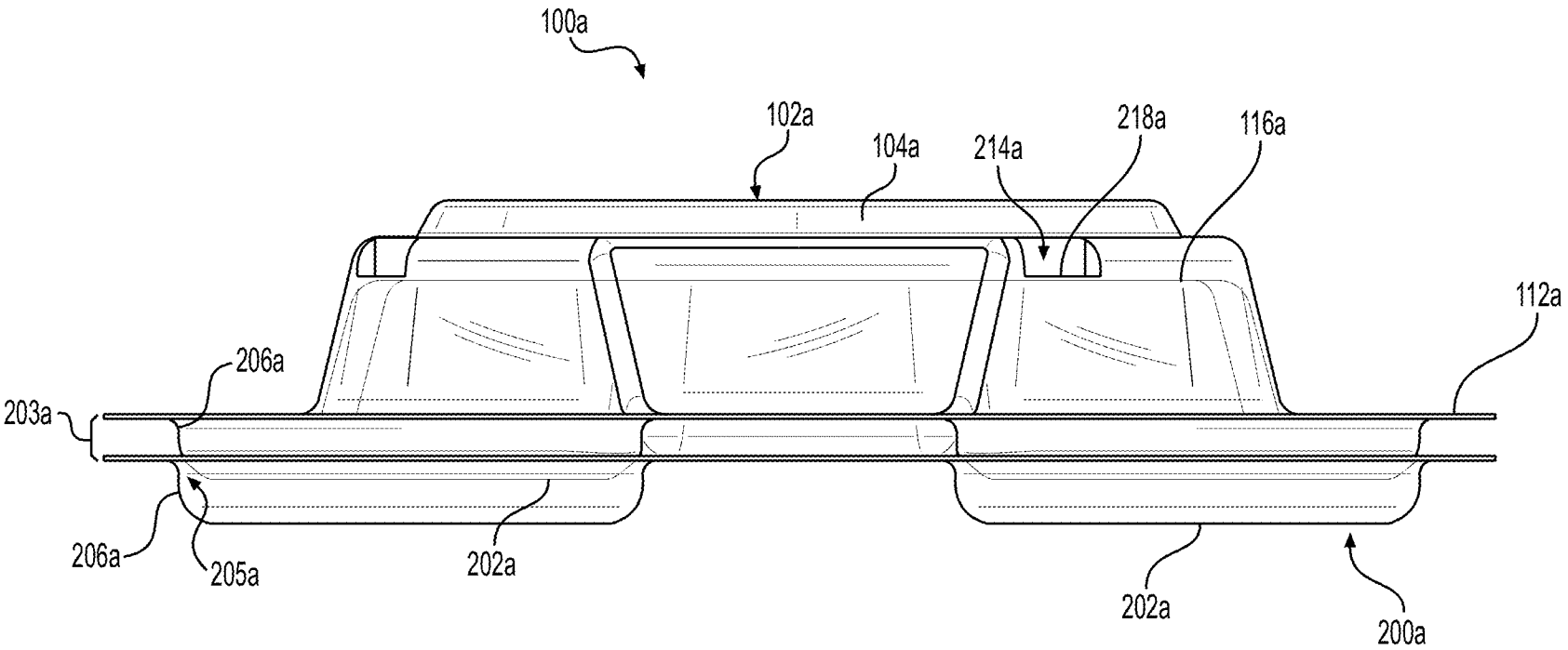
FIG. 13 is an illustration of a side view of stacked trays, in accordance with an example embodiment.

FIG. 13 is an illustration of a side view of stacked trays 100*a*, in accordance with an example embodiment. In an example embodiment, and as shown in FIG. 13, the bottom surface 218*a* of the notch 214*a* of the upper tray 100*a* contacts the upper surface 116*a* of the lower tray 100*a*, when the trays 100*a* are stacked. In an example embodiment, the notch 214*a* keeps the trays 100*a* separated by a distance 203*a*, and causes a gap 205*a* to be maintained between the walls 206*a* of the depression 200*a* of each of the trays 100*a*, thereby allowing the trays 100*a* to later be separated more easily while ensuring that moisture does not collect between the trays 100*a*.

Figure 14:
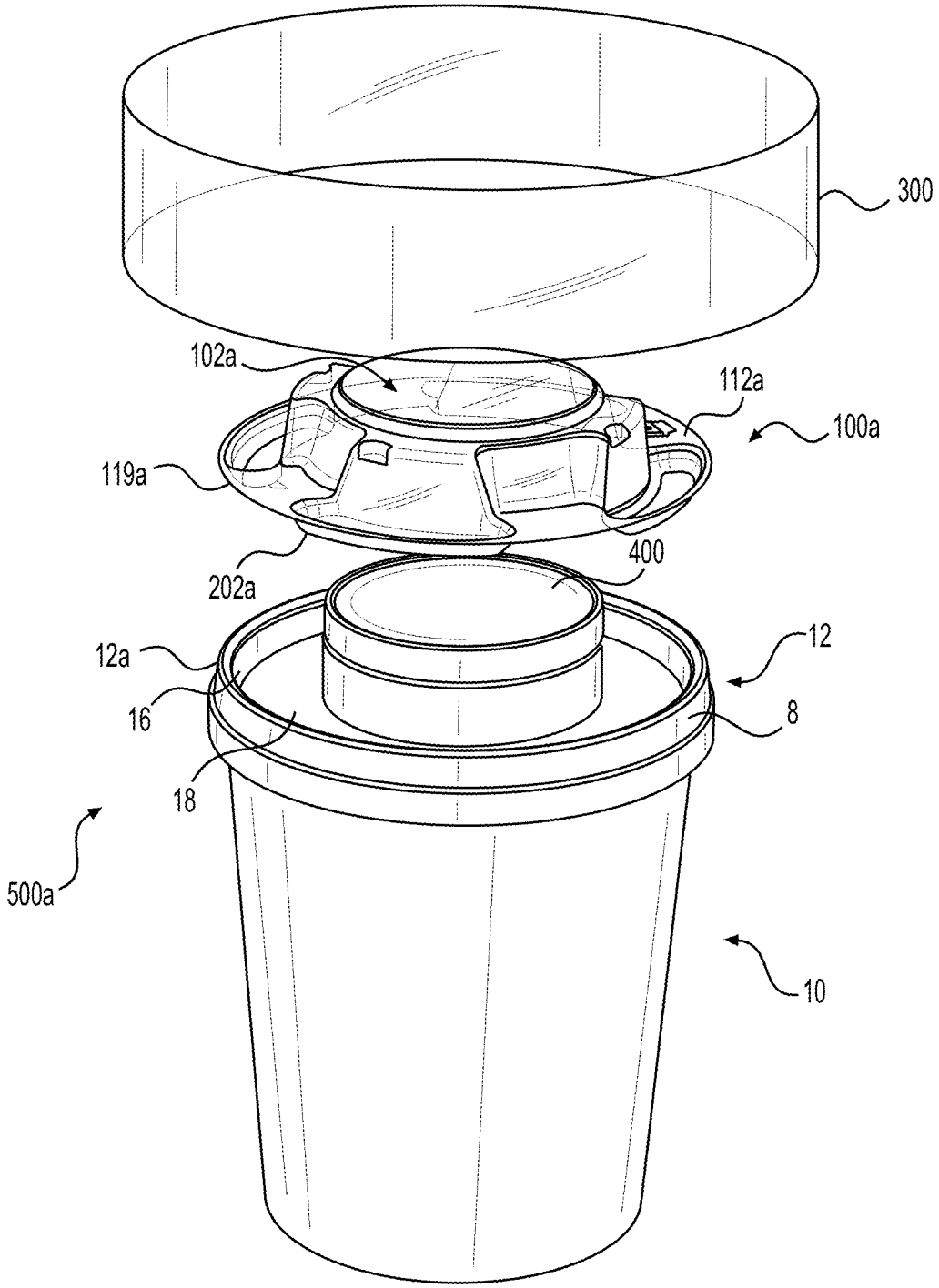
FIG. 14 is an illustration of an exploded view of a package, in accordance with an example embodiment.

FIG. 14 is an illustration of an exploded view of the package 500*a*, in accordance with an example embodiment. In an example embodiment, the package 500*a* includes the tub 10, the consumer product 400, the tray 100*a* and shrink wrap 300. In an example embodiment, the tray 100*a* overlays the consumer product 400 to assist in stably connecting the consumer product 400 to a top portion of the tub. 10 (also see FIG. 15). In an example embodiment, the package 500*a* is used to store, distribute and sell the consumer product 400, with additional products in the tub 10. In an example embodiment, the consumer product 400 is a sample or an extra product that is either related or unrelated to the additional products in the tub 10. In an example embodiment, the tray 100*a* provides stability for the consumer product 400 and the tub 10, as the consumer product 400 is connected to a top of the tub 10, and other packages 500*a* are stacked on top of the consumer product 400 and the tub 10. In an example embodiment, the consumer product 400 is a physically smaller product, or in a relatively smaller package, as compared to a size of the tub 10. In an example embodiment, the tray 100*a* allows the consumer product 400 to be displayed and/or viewed while attached to the tub 10 by the tray 100*a*. In an example embodiment, the tray 100*a* allows the tub 10 and the consumer product 400 to be vertically stacked on top of other tubs 10 and consumer products 400.

In an example embodiment, the consumer product 400 is a canister of smokeless tobacco. In an example embodiment, the additional products in the tub 10 are smokeless tobacco, or other types of products. In an example embodiment, the consumer product 400 is a canister or container that contains an oral product. The oral product may be a tobacco product or a non-tobacco product. The oral product may include chewing tobacco, snus, moist snuff tobacco, dry snuff tobacco, or other smokeless tobacco and non-tobacco products for oral consumption. A smokeless tobacco product may include tobacco that is whole, shredded, cut, granulated, reconstituted, cured, aged, fermented, pasteurized, or otherwise processed. Tobacco may be present as portions of leaves, flowers, roots, stems, extracts, or any combination thereof. In at least one example embodiment, the oral product includes a tobacco extract, such as a tobacco-derived nicotine extract (e.g., white snus) alone or in combination with non-tobacco cellulosic materials (e.g., microcrystalline cellulose (MCC). Where the oral product includes nicotine, with or without tobacco, the nicotine may be tobacco-derived nicotine or synthetic nicotine. The oral product may be provided loose, in a pouch, as a plug or twist, or in a desired shape. The oral product may be in the form of lozenges, chews, gums, pouches, sticks, tablets, pastilles, or any other suitable form.

The oral product may have various ranges of moisture. In at least one example embodiment, the oral product is a dry oral product having a moisture content ranging from 5% by weight to 10% by weight. In at least one example embodiment, the oral product has a medium moisture content, such as a moisture content ranging from 20% by weight to 35% by weight. In at least one example embodiment, the oral product is a wet oral product having a moisture content ranging from 40% by weight to 55% by weight.

The tobacco products may include smokeless tobacco pouches, for example. The non-tobacco products may include herbal compositions, pharmaceutical medications, or other non-tobacco products. Herbs and other edible plants can be categorized generally as culinary herbs (e.g., thyme, lavender, rosemary, coriander, dill, mint, peppermint) and medicinal herbs (e.g., Dahlias, Cinchona, Foxglove, Meadowsweet, *Echinacea*, Elderberry, Willow bark). In some example embodiments, the non-tobacco products may include cannabis or cannabis extracts.

In an example embodiment, the tray 100*a* is used to hold the consumer product 400 on top of the tub 10.

In an example embodiment, the tray 100 (FIG. 6) or the tray 100*b* (FIG. 17) are used, in lieu of the tray 100*a* (FIG. 10), to hold the consumer product 400 on the upper surface 18 of the lid 8 of the tub 10. While any of the example embodiments of the tray may be used in conjunction with the tub 10, the further discussion of FIGS. 14-16 (below) will focus primarily on the tray 100*a* of FIG. 10.

In an example embodiment, the shrink wrap (shrink band) 300 is used to cover some or all of the of the tray 100*a*, and a top portion of the tub 10, in order to hold the tray 100*a* and the consumer product 400 onto the tub 10. In an example embodiment, the shrink wrap 300 is applied to the tray 100*a* and the tub 10, and then the shrink wrap 300 is heated to cause the shrink wrap 300 to better conform to, and adhere to, the tray 100*a* and the tub 10. In an example embodiment, the shrink wrap 300 is a polymer material that shrinks tightly when a moderate level of heat is applied to the shrink wrap 300. In an example embodiment, the shrink wrap 300 is applied to a portion of the tray 100*a* and the tub 10 without an application of heat. In an example embodiment, the shrink wrap 300 is a polyolefin, PVC, polyethylene, polypropylene, another suitable heat-shrinkable material, or combinations thereof. In an example embodiment, the tray 100*a* allows for a relatively lower amount of shrink wrap 300 to be applied to the tub 10 and the consumer product 400, compared to an amount of the shrink wrap 300 that may be used to connect the consumer product 400 to the tub without the tray 100*a*.

FIG. 15 is an illustration of a cross-sectional view of the package 500*a*, in accordance with an example embodiment. In an example embodiment, and as shown in FIG. 15, the distal end 119*a* of the brim 112*a* of the tray 100*a* extends to reach over the top of, and be partially supported by, the distal edge 12*a* of the brim 12 of the lid 8 of the tub 10.

In an example embodiment, the shrink wrap 300 is placed to cover at least a portion of the tray 100*a* and at least a portion of the tub 10. In an example embodiment, a first distal end 300*a* of the shrink wrap 300 extends down to the base 2, thereby covering the outer surface 5 of the collar 4. This can ensure that the pull tab 3*c* (FIG. 1) of the tub 10 is not inadvertently detached prior to the package 500*a* being intentionally opened. In an example embodiment, a second distal end 300*b* of the shrink wrap 300 extends across at least a portion of the brim 112*a* of the tray 100*a*. This can ensure that the tray 100*a* stays firmly affixed to the lid 8 of the tub 10. In another example embodiment, the shrink wrap 300 covers an entire outer surface of the tray 100*a*.

In an example embodiment, the depression 200*a* does not extend down to the upper surface 18 of the lid 8 of the tub 10 (as shown in better detail in FIG. 16). This can allow for tolerances in a height of the distal edge 12*a* of the brim 12 of the tub 10. In another example embodiment, the depression 200*a* extends downward and contacts the upper surface 18 of the lid 8 of the tub 10. This can allow the tray 100*a* to be further structurally supported by the tub 10 to withstand a further load on the upper surface 116*a* of the tray 100*a*.

In an example embodiment, the upper surface 116*a* of the tray 100*a* contacts at least a periphery of an upper-most surface of a lid 401 of the consumer product 400 to hold the consumer product 400 firmly on the tub 10. In an example embodiment, at least a portion of sidewalls 111*a* of the tray 100*a* encompass and hold the consumer product 400. In an example embodiment, the back wall 120*a* of each recess 108 (see FIG. 10) contacts and holds an outer surface of the consumer product 400. In an example embodiment, the annular surface 104*a* raises a height of the dome 102*a* so that a gap 131 exists between a top surface 105*a* of the dome 102*a* and an upper-most surface of the lid 401 of the consumer product 400. In an example embodiment, the gap 131 can provide shock-absorption in the event that a structural load is suddenly applied to a top portion of the package 500*a*, where the shock-absorption can mitigate a compression and/or crushing of the consumer product 400.

FIG. 16 is an illustration of a cross-sectional view of stacked packages 500*a*, in accordance with an example embodiment. In an example embodiment, and as shown in FIG. 16, the dome 102*a* of the tray 100*a* fits into the recessed area 20 of the base 2 of the tub 10, when the packages 500*a* are stacked. In an example embodiment, the annular surface 104*a* of the tray 100*a* mates with the side surface 24 of the base 2 of the tub 10, while the bottom surface 22 of the tub 10 is supported by the upper surface 116*a* of the tray 100*a*, to allow the upper tub 10 to remain stably connected to the lower package 500*a*.

Figure 17:
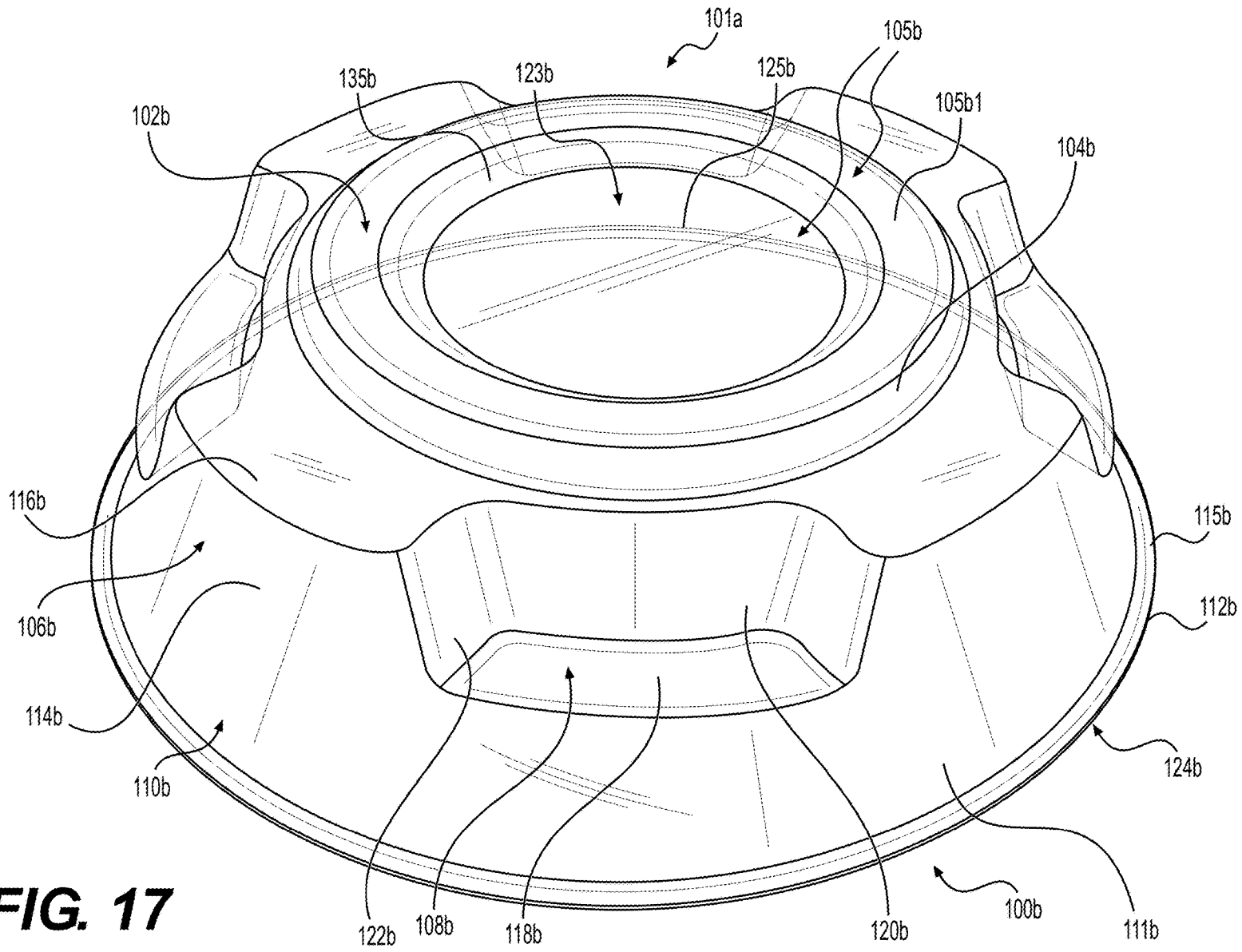
FIG. 17 is an illustration of an upper perspective view of another tray, in accordance with an example embodiment.

FIG. 17 is an illustration of an upper perspective view of another tray 100*b*, in accordance with an example embodiment. For brevity sake, like references numbers are the same as those described in relation to the tray 100 (FIG. 6) and the tray 100*a* (FIG. 10), with the following exceptions described herein.

In an example embodiment, the tray 100*b* includes a dome 102*b* extending upward from an upper surface 116*b* of the tray 100*b*. In an example embodiment, and as shown in FIG. 17, a top surface 105*b* of the dome 102*b* defines a depression 123*b*. In an example embodiment, the depression 123*b* has a center surface 125*b*. In an example embodiment, the center surface 125*b* is at a same vertical elevation as the upper surface 116*b*. In an example embodiment, and as shown in FIG. 17, the top surface 105*b* of the dome 102*b* defines a ridge 105*b*1 that is a highest vertical elevation of the tray 100*b* and the dome 102*b*. In an example embodiment, the ridge 105*b*1 is an annular ridge. In an example embodiment, an annular surface 104*b* and an interior wall 135*b* are on either side of the ridge 105*b*1. In an example embodiment, the annular surface 104*b* and the interior wall 135*b* are both inclined inward toward the ridge 105*b*1. In an example embodiment, the ridge 105*b*1 provides extra strength to the tray 100*b* to allow the tray 100*b* to support extra loads applied to an upper end 101*a* of the tray 100*b*. In an example embodiment, the ridge 105*b*1 offers shock-absorption that can mitigate a compression and/or crushing of the tray 100*b*, or the consumer product 400 in the tray 100*b*. In an example embodiment, a depression that is the same as the depression 123*b* of the tray 100*b* can be included in either or both of the tray 100 (FIG. 6) and the tray 100*a* (FIG. 10).

Figure 19:
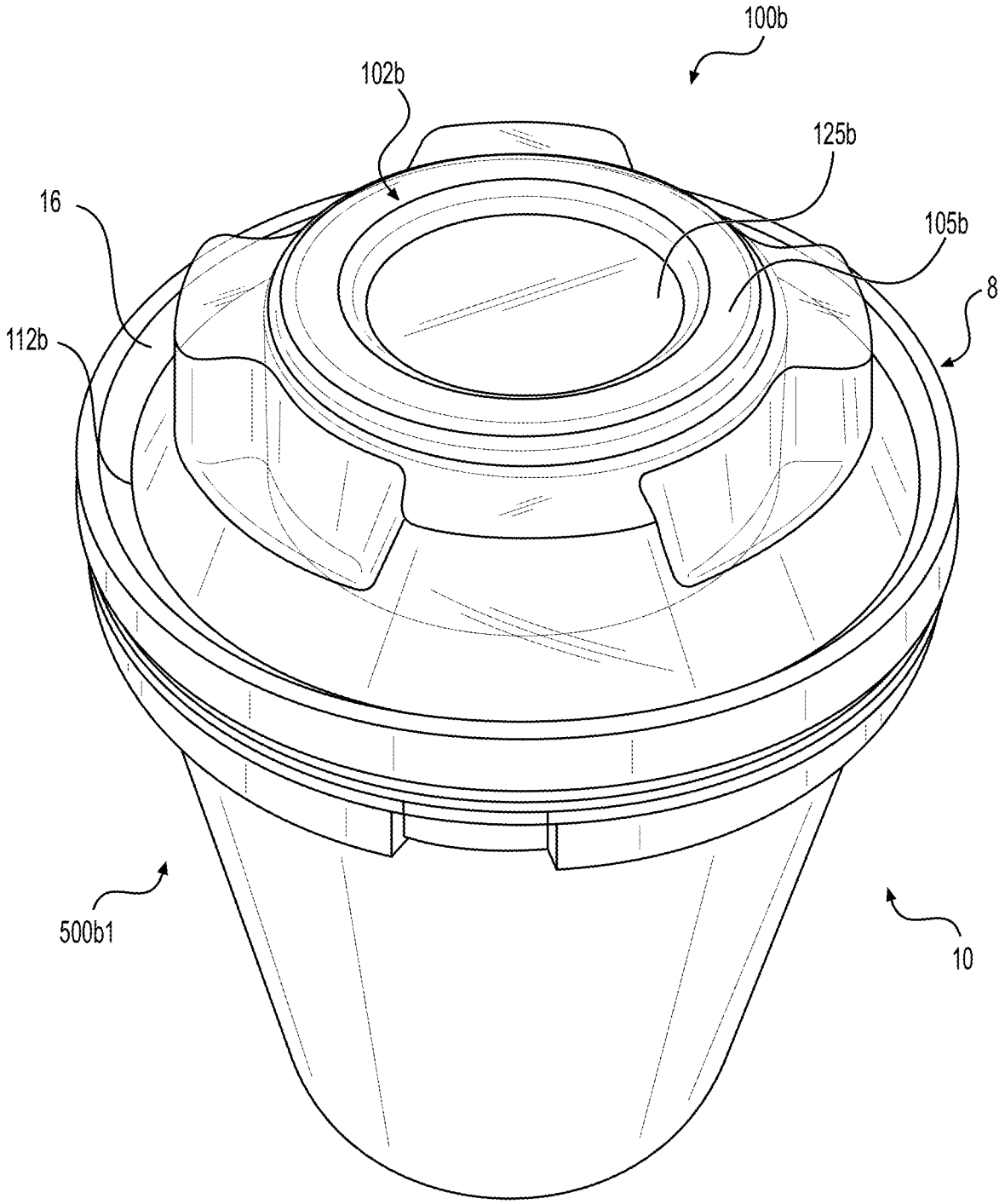
FIG. 19 is an illustration of a perspective view of another package that is partially assembled, in accordance with an example embodiment.

In an example embodiment, a brim 112*b* of the tray 100*b* is relatively narrow in order to fit within the inner surface 16 of the tub 10 (see FIGS. 2 and 19). In this embodiment, the lower major surface 124*b* of the brim 112*b* of the tray 100*b* sits directly on, and is supported by, the upper surface 18 of the lid 8 of the tub 10, as shown in at least FIG. 19.

In an example embodiment, the tray 100*b* includes one or more petaloids 106*b* that extend upward from a base 110*a* of the tray 100*a*, where a number and an orientation of the petaloids 106*b* can be the same as the petaloids 106 of the tray 100 (FIG. 6). In an example embodiment, the tray 100*b* includes a recess 108*b* between each petaloid 106*b*, where a number and an orientation of the recesses 108*b* can be the same as the recesses 108 of the tray 100 (FIG. 6).

In an example embodiment, a back wall 120*b* of the recess 108*b*, a sidewall 111*b* of the base 110*b*, an outer surface 114*b* of the petaloid 106*b* and/or the annular surface 104*b* are inclined toward the center surface 125*b*, at an incline angle that matches the inline angle 130 of the tray 100 (FIG. 6). In another example embodiment, the back wall 120*b*, the sidewall 111*b*, the outer surface 114*b* and/or the annular surface 104*b* are not inclined, but instead are about perpendicular to a horizontal plane of the lower major surface 124*b* of the brim 112*b*.

Figure 18:
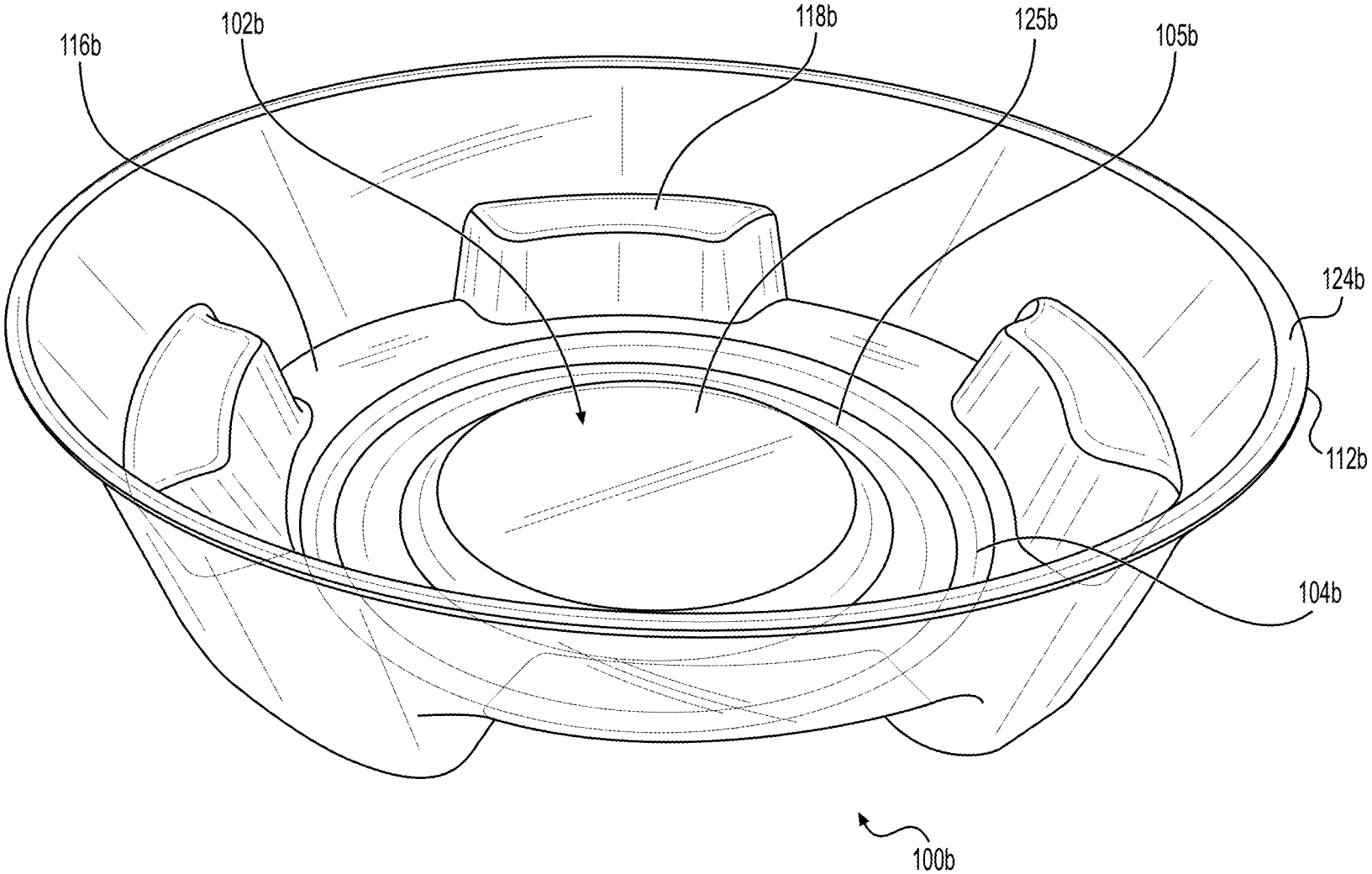
FIG. 18 is an illustration of a lower perspective view of the tray of FIG. 17, in accordance with an example embodiment.

FIG. 18 is an illustration of a lower perspective view of the tray 100*b* of FIG. 17, in accordance with an example embodiment. In an example embodiment, the center surface 125*b* of the dome 102*b* of the tray 100*b* extends down into an interior of the tray 100*b*, while the ridge 105*b*1 of the dome 102*b* extends upward and away from the upper surface 116*b* and the center surface 125*b* (as shown in better detail in FIG. 17). In an example embodiment, the ridge 105*b*1 offers shock-absorption that can mitigate a compression and/or crushing of the tray 100*b*, or the consumer product 400 in the tray 100*b*. In an example embodiment, the ridge 105*b*1 is an annular ridge with a circular shape that is substantially conformed to a circular upper surface of the lid 401 of the consumer product (see FIGS. 14 and 15).

FIG. 19 is an illustration of a perspective view of another package 500*b*1 that is partially assembled, in accordance with an example embodiment. The package 500*b*1 is partially assembled, from the standpoint that shrink wrap or other structure has not yet been applied to securely connect the tray 100*b* to the tub. 10. In an example embodiment, the brim 112*b* of the tray 100*b* is narrow enough that the brim 112*b* fits inside of the inner surface 16 of the lid 8. In this example embodiment, the brim 112*b* of the tray 100*b* sits directly on the upper surface 18 (see FIG. 2) of the lid 8 of the tub 10.

FIG. 20 is an illustration of a perspective view of stacked tubs 10 using the tray 100*b*, in accordance with an example embodiment. In an example embodiment, and as shown in FIG. 20, a package 500*b* can be used to support another single tub 10. In an example embodiment, the package 500*b* is an assembled package with shrink wrap 300 connecting the tray 100*b* and consumer product 400 to a top of the lower tub 10. In an example embodiment, and as shown in FIG. 20, an upper tub 10 can sit on top of the package 500*b*. This configuration of stacked tubs 10 can allow for some tubs 10 to include a consumer product 400 that is connected to the tub 10 with the tray 100*b* (e.g. the package 500*b*), while other single tubs 10 without a consumer product 400 can be stacked on the package 500*b*. In an example embodiment, another package 500*b* can be stacked on top of the lower package 500*b*. As previously explained, the package 500*b* can alternatively use the tray 100 (FIG. 6) or the tray 100*a* (FIG. 10) to connect the consumer product 400 to the tub 10.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A first tray, comprising:

a base, the base including first sidewalls that are substantially cylindrically shaped;

a first upper surface on an upper end of the base;

a dome, the dome extending upwardly and away from the first upper surface, the first upper surface and the dome closing the upper end; and a first brim, the first brim radially extending from a first lower end of the base, the first brim defining a first set of depressions that extend below a lower major surface of the first brim, the lower major surface being substantially flat, the first sidewalls and the first upper surface combining to define two or more notches along an upper periphery of the base, each of the two or more notches including a bottom surface that extends into an interior of the first tray, the first tray being configured to stack on top of a second tray that is identical to the first tray such that a lower part of the first set of depressions fits partially within an upper part of a second set of depressions of the second tray while the two or more notches maintain a separation between the first tray and the second tray, the first sidewalls and the first upper surface combine to define two or more recesses along an upper periphery of the base, each of the recesses including a step, the two or more recesses being spaced equidistantly around a center-point of the first upper surface.

2. The first tray of claim 1, wherein two or more petaloids exist between the two or more recesses, the two or more petaloids being defined by the first upper surface, the first sidewalls, and side panels of each of the two or more recesses, the two or more petaloids being spaced equidistantly around the center-point, and the side panels being on either side of a back wall of each of the two or more recesses.

3. The first tray of claim 1, wherein the dome is centrally positioned on the first upper surface, the dome having a horizontal cross-section that is circular.

4. The first tray of claim 3, wherein the dome includes an annular side surface, the annular side surface being inclined toward a center-point of a top surface of the dome.

5. The first tray of claim 2, wherein the two or more petaloids include four petaloids, and the two or more recesses include four recesses.

6. The first tray of claim 2, wherein the first sidewalls and the back wall of each of the two or more recesses are inclined toward a center-point of a top surface of the dome.

7. The first tray of claim 2, wherein one of the first set of depressions is positioned in front of each one of the two or more petaloids.

8. The first tray of claim 2, wherein the bottom surface of each of the two or more notches is positioned to contact a second upper surface of the second tray, in order to maintain the separation between the first tray and the second tray once the first tray is stacked on top of the second tray.

9. The first tray of claim 2, wherein an upper portion of each of the two or more petaloids includes one of the two or more notches.

10. The first tray of claim 1, wherein the first brim includes an upper major surface, the upper major surface being substantially flat, from a proximal end of the first brim that is connected to the first lower end of the base to a distal end of the first brim.

11. The first tray of claim 1, wherein the first tray is symmetrical about any imaginary vertical plane that traverses through the center-point.

12. A package, comprising:

the first tray of claim 1;

a first tub; and a consumer product, the first tray overlaying the consumer product to connect the consumer product to a top portion of the first tub.

13. The package of claim 12, wherein the dome of the first tray is configured to fit into, and mate with, a recessed area at a second lower end of a second tub to allow the second tub to be stacked on top of, and remain stably connected to, the package.

14. The package of claim 12, wherein the first brim extends to reach over and contact a distal edge of a second brim of a lid of the first tub.

15. The package of claim 12, wherein the first brim includes a lower major surface that is substantially flat, and the lower major surface of the first tray sits on top of a third upper surface of a lid of the first tub.

16. The package of claim 12, wherein at least one first portion of the first sidewalls encompass and hold second sidewalls of the consumer product.

17. The package of claim 16, wherein two or more petaloids exist between the two or more recesses, the two or more petaloids being defined by the first upper surface, the first sidewalls, and side panels of each of the two or more recesses, the two or more petaloids being spaced equidistantly around the center-point, and the side panels being on either side of a back wall of each of the two or more recesses.

18. The package of claim 17, wherein the at least one first portion of the first sidewalls of the base include at least part of the back wall of each of the two or more recesses, at least one second portion of the first upper surface of the first tray directly contacts a periphery of an upper-most surface of the consumer product, and a top surface of the dome and the upper-most surface of the consumer product define a gap therebetween.

19. The package of claim 16, further comprising:

shrink wrap, the shrink wrap covering at least one second portion of the first tray and an at least one third portion of an upper portion of the first tub.

* * * * *